US011299811B2

(12) United States Patent
Tacconi et al.

(10) Patent No.: US 11,299,811 B2
(45) Date of Patent: Apr. 12, 2022

(54) CONTINUOUS FLOW REACTOR AND HYBRID ELECTRO-CATALYST FOR HIGH SELECTIVITY PRODUCTION OF C2H4 FROM CO2 AND WATER VIA ELECTROLYSIS

(71) Applicant: Board of Regents, The University of Texas System, Austin, TX (US)

(72) Inventors: Norma S. Tacconi, Arlington, TX (US); Wilaiwan Chanmanee, Grand Prairie, TX (US); Brian Dennis, Arlington, TX (US); Krishnan Rajeshwar, Arlington, TX (US)

(73) Assignee: Board of Regents, The University of Texas System, Austin, TX (US)

( * ) Notice: Subject to any disclaimer, the term of this patent is extended or adjusted under 35 U.S.C. 154(b) by 0 days.

(21) Appl. No.: 16/261,484

(22) Filed: Jan. 29, 2019

(65) Prior Publication Data

US 2019/0233954 A1 Aug. 1, 2019

Related U.S. Application Data

(60) Provisional application No. 62/623,087, filed on Jan. 29, 2018.

(51) Int. Cl.
*C25B 11/091* (2021.01)
*C25B 3/25* (2021.01)
(Continued)

(52) U.S. Cl.
CPC ..... *C25B 11/091* (2021.01); *C25B 3/25* (2021.01); *C25B 11/031* (2021.01); *C25B 11/051* (2021.01)

(58) Field of Classification Search
CPC .... C25B 3/04; C25B 9/00; C25B 9/13; C25B 9/15; C25B 9/17; C25B 11/091; C25B 3/25; C25B 11/031; C25B 11/051
See application file for complete search history.

(56) References Cited

U.S. PATENT DOCUMENTS 4,328,287 A 5/1982 Sammells et al.
5,480,735 A 1/1996 Landsman et al.
(Continued)

FOREIGN PATENT DOCUMENTS

CN 101657568 2/2010
CN 102449199 3/2011
(Continued)

OTHER PUBLICATIONS

Ogura et al., Selective formation of ethylene from CO2 by catalytic electroysis at a three-phase interface, Elsevier. Catalysis Today 98 (2004), pp. 515-521. (Year: 2004).*
(Continued)

*Primary Examiner* — Ciel P Contreras
(74) *Attorney, Agent, or Firm* — Pabst Patent Group LLP

(57) ABSTRACT

An electrochemical reactor for use with a liquid electrolyte is capable of generating gaseous products. An electrically conducting porous layer that is hydrophilic on the catalyst side and hydrophobic on the gas side are utilized. These different surface properties promote the transport of product gases formed at the catalyst through the porous layer to the gas side. The catalyst is formed from a hybrid $Cu_2O$—CuBr film that has a high selectivity for ethylene gas from reacting $CO_2$ and water in an electrochemical cell.

12 Claims, 29 Drawing Sheets

(51) Int. Cl.
*C25B 11/031* (2021.01)
*C25B 11/051* (2021.01)

(56) References Cited

U.S. PATENT DOCUMENTS

| | | | | |
|---|---|---|---|---|
| 6,638,413 | B1 * | 10/2003 | Weinberg | C25B 1/02 204/157.5 |
| 2009/0000574 | A1 * | 1/2009 | Sugimasa | B60L 53/51 123/3 |
| 2009/0057161 | A1 * | 3/2009 | Aulich | C25B 1/00 205/436 |
| 2010/0180889 | A1 * | 7/2010 | Monzyk | C25B 3/04 128/202.26 |
| 2013/0008354 | A1 * | 1/2013 | Constantz | C25B 1/00 106/801 |
| 2013/0228470 | A1 | 9/2013 | Chen | |
| 2014/0299482 | A1 | 10/2014 | Oloman | |
| 2016/0017503 | A1 * | 1/2016 | Kaczur | C25B 15/08 205/346 |
| 2016/0369412 | A1 * | 12/2016 | Krasovic | C25B 9/23 |
| 2017/0306510 | A1 * | 10/2017 | Rothschild | C25B 9/06 |
| 2018/0230612 | A1 * | 8/2018 | Krause | C25B 11/0405 |
| 2019/0112720 | A1 * | 4/2019 | Skinn | H01M 4/8605 |

FOREIGN PATENT DOCUMENTS

| | | | | |
|---|---|---|---|---|
| CN | 105316700 | | 7/2014 | |
| JP | 02054790 | A * | 2/1990 | C25B 1/00 |

OTHER PUBLICATIONS

Endrddi et al., Continuous-flow electroreduction of carbon dioxide, Progress in Energy and Combustion Science K2017) 133-154, 62.

De Tacconi et al.. Composite copper oxide-copper bromide films for the selective electroreduction of carbon dioxide, Journal of Materials Research (May 15, 2017) 1727-1734, vol. 32, Issue 9.

Durst, Julien, et al.. "Electrochemical C02 Reduction - A Critical View on Fundamentals, Materials and Applications." Energy Storage Research in Switzerland - The SCCER Heat & Electricity Storage, vol. 69, No. 12, Aug. 19, 2015, pp. 769-776.

Jhong, Huei-ru Molly. "Design and Characterization of Catalysts and Electrodes for Electrochemical Energy Conversion Applications." University of Illinois at Urbana-Champaign, 2014.

Whipple, Devin T. "Microfluidic Reactor for the Electrochemical Reduction of Carbon Dioxide: The Effect of PH." Electrochemical and Solid-State Letters, vol. 13, No. 9, Jun. 29, 2010, pp. B109-B111.

Delacourt, Charles. "Electrochemical Reduction of Carbon Dioxide and Water to Syngas (Co H2) at Room Temperature." University of California Berkeley, 2006.

Whipple, Devin T. "Microfluidic Platform for Studying the Electrochemical Reduction of Carbon Dioxide." University of Illinois at Urbana-Champaign, 2011.

Kunna, Wu. "Modeling of the Electrochemical Conversion of CO2 in Microfluidic Reactors." University of Illinois at Urbana-Champaign, 2015.

* cited by examiner

17A

17B

17C

17D

18A $Cu_2O$-CuBr (N-ED 15)

| Element | Wt % | At % |
|---|---|---|
| O K | 24.27 | 58.06 |
| CuL | 45.87 | 27.63 |
| BrL | 29.86 | 14.30 |
| Total | 100.00 | 100.00 |

18B $Cu_2O$/CuBr (L-ED 15/5)

| Element | Wt % | At % |
|---|---|---|
| O K | 19.91 | 49.89 |
| CuL | 76.87 | 48.50 |
| BrL | 3.22 | 1.61 |
| Total | 100.00 | 100.00 |

18C $Cu_2O$-CuBr (L-ED 15)

| Element | Wt % | At % |
|---|---|---|
| O K | 16.43 | 44.00 |
| CuL | 81.00 | 54.62 |
| BrL | 2.58 | 1.38 |
| Total | 100.00 | 100.00 |

18D $Cu_2O$-CuBr (L-ED 20)

| Element | Wt % | At % |
|---|---|---|
| O K | 16.52 | 44.17 |
| CuL | 80.80 | 54.39 |
| BrL | 2.68 | 1.44 |
| Total | 100.00 | 100.00 |

| N- and L-Films | EDAX chemical composition |
|---|---|
| $Cu_2O$-CuBr (N-ED15) (region 1) | 32 % $Cu_2O$ - 68 % CuBr |
| $Cu_2O$-CuBr (N-ED15) (region 2) | 15 % $Cu_2O$ - 85 % CuBr |
| $Cu_2O$-CuBr (L9-ED15/5) (regions 1 & 2) | 93 % $Cu_2O$ - 7 % CuBr |
| $Cu_2O$-CuBr (L9-ED15) (regions 1 & 2) | 95 % $Cu_2O$ - 5 % CuBr |
| $Cu_2O$-CuBr (L9-ED20) (regions 1 & 2) | 95 % $Cu_2O$ - 5 % CuBr |
| $Cu_2O$-CuBr (L9-ED30) (regions 1 & 2) | 95 % $Cu_2O$ - 5 % CuBr |
| $Cu_2O$-CuBr (L7-EDτ), EDQ = 5 C/cm$^2$ (region 1) | 25 % $Cu_2O$ - 10 % CuBr - 65 % Cu |
| $Cu_2O$-CuBr (L7-EDτ), EDQ = 5 C/cm$^2$ (region 2) | 18 % $Cu_2O$ - 52 % CuBr - 30 % Cu |

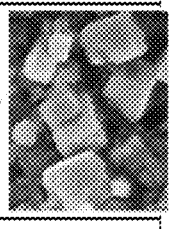

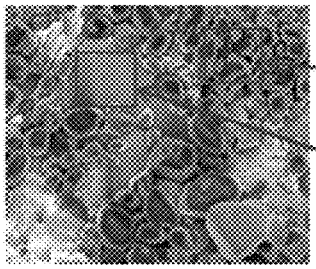

23A

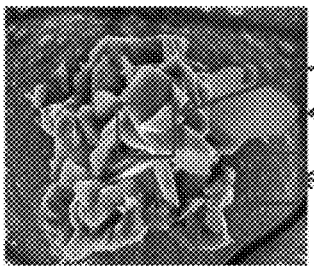

23B

FIG. 23A-23B

CONTINUOUS FLOW REACTOR AND HYBRID ELECTRO-CATALYST FOR HIGH SELECTIVITY PRODUCTION OF C2H4 FROM CO2 AND WATER VIA ELECTROLYSIS

RELATED APPLICATIONS

This application claims priority to U.S. Provisional Patent Application 62/623,087 filed on Jan. 29, 2018 which is specifically incorporated by reference in its entirety herein.

GOVERNMENT FUNDING

This invention was made with government support under grant NNL15AA08C awarded by NASA. The government has certain rights in the invention.

FIELD

The disclosure relates generally to the field of electrochemical reactions. The disclosure relates specifically to apparatus for reducing carbon dioxide to a reduction product.

BACKGROUND

Finding adequate solutions for a diversified and sustainable energy supply is undoubtedly one of the grand challenges of our society today. At the same time, the steeply rising level of carbon dioxide ($CO_2$) in the atmosphere calls for conceptually new approaches to capture and utilize this greenhouse gas. Using renewable energy to convert $CO_2$ to transportation fuels and commodity chemicals is a value-added approach to simultaneous generation of products and environmental remediation of carbon emissions. The large amounts of chemicals produced worldwide that can be potentially derived from the hydrogenation of $CO_2$ highlights further the importance of this strategy. Several industrial entities are interested in such technologies, ranging from energy/utilities companies through cement producing and processing firms to oil and gas companies.

There are numerous routes for converting $CO_2$ to transportation fuels and other chemicals. A promising technology is an electrochemical (EC) approach which involves reducing $CO_2$ to organic compounds using electrical potential (instead of temperature or chemical reducing agents) as the driving force for the uphill reactions. Extensive research has been done to propose various reactors for the electrochemical reduction of $CO_2$. To increase the $CO_2$ conversion rate to a level of practical significance, electrochemical $CO_2$ reduction is performed in a continuous-flow setup to overcome mass-transport limitations. Continuous-flow reactors have multiple benefits compared to their batch counterparts. Among others, these include increased mass transfer and improved mixing of different phases, better temperature and heat transfer control, and more precise influence on the reaction mixture residence time in the reactor.

An example of a typical reactor using a flowing liquid electrolyte to separate a cathode and anode may be found in "Continuous-flow electroreduction of carbon dioxide" (B Endrődi et. al, Progress in Energy and Combustion Science 62(2017) 133-154), which is herein incorporated by reference in its entirety.

Various electrodes derived from main group and transition metals have been deployed for $CO_2$ reduction. Of these, copper is unique in its ability to reduce $CO_2$ to hydrocarbons at ambient temperature and pressure. However, one of the main challenges with copper is that it lacks selectivity for one product and it suffers from the handicap that electrocatalytic activity for $CO_2$ reduction decreases rapidly after some tens of minutes of electrolysis. Embodiments of the electrodes can be found in "Norma R. de Tacconi et al., Composite copper oxide-copper bromide films for the selective electroreduction of carbon dioxide, Journal of Materials Research, Vol. 32, Issue 9, 15 May 2017, pp. 1727-1734" which is herein incorporated by reference in its entirety.

Efficient $CO_2$ electrolysis requires not only a high catalytic activity but also high $CO_2$ flux to the cathode/electrolyte interface. A three-phase ($CO_2$ gas/solid/liquid) system is known to enhance and extend the EC performance in this regard. It has also been demonstrated that oxide layers on Cu surfaces derived from copper(I) halide (e.g., chloride) precursors are effective for the selective EC conversion of $CO_2$.

Improved reactors for $CO_2$ reduction are needed that can increase production capacity and have high selectivity for one product.

SUMMARY

An embodiment of the disclosure is an electrochemical reactor for use with an electrolyte that generate gaseous products, comprising: a solid or liquid electrolyte; an electrolyte channel sandwiched between two gas channels; two electrode layers separating the electrolyte channel and the two gas channels respectively; wherein each of the two electrode layers is hydrophilic on the catalyst side and hydrophobic on the gas side. In an embodiment, the electrode layer comprises an electrically conducting porous layer and a catalyst on the catalyst side of thereof. In an embodiment, the electrically conducting porous layer is made from a hydrophobic material. In an embodiment, the hydrophobic material is PTFE. In an embodiment, the catalyst is electrodeposited on the catalyst side of the electrically conducting porous layer. In an embodiment, the catalyst can be Pt, Ru, Cu, Ti, Ni, or Cu—Br. In an embodiment, the catalyst is formed from a hybrid Cu2O—CuBr film. In an embodiment, the electrolyte is an anion conducting electrolyte. In an embodiment, the electrolyte is a cation conducting electrolyte. In an embodiment, the electrolyte is NaOH, $NaHCO_3$, KOH, or $Na_2SO_4$.

An embodiment of the disclosure is a system for producing $C_2H_4$ from $CO_2$, comprising an electrochemical reactor. In an embodiment, the voltage applied to the electrode layers is square voltage pulses. In an embodiment, the liquid electrolyte is pumped continuously into the electrolyte layer of the electrochemical reactor.

An embodiment of the disclosure is a method for electrodepositing a hybrid $Cu_2O$—CuBr film on a gas diffusion layer (GDL) support material, comprising: providing a water-soluble copper solution; providing a complexing agent; adjusting pH of the solution to target a simultaneous deposition of cubic nanostructures composed of copper, oxygen, and a halogen. In an embodiment, the solution comprises $CuSO_4$ and NaBr. In an embodiment, the complexing agent comprises lactic acid. In an embodiment, adjusting pH of the solution comprises adjusting the pH to 7 to 9. In an embodiment, the method further comprises electrodepositing the film at about −0.4 V for 15-20 min. In an embodiment, the method further comprises electrodepositing the film at about −0.4V for 15 minutes, adding a NaBr-containing solution to the cathode compartment, and continuing electrodeposition for 5 min. In an embodiment, the ratio of molar lactic acid to cupric cation is about 10.

Certain embodiments of the disclosure pertain to an electrochemical reactor for use with a liquid electrolyte that generates gaseous products. The reactor comprises an electrolyte channel sandwiched between two gas channels, two electrode layers separate the electrolyte channel and the two gas channels respectively, each of the two electrode layers is hydrophilic on the catalyst side and hydrophobic on the gas side. These different surface properties promote the transport of product gases formed at the catalyst through the electrode layer to the gas side. This allows the reactor to automatically separate the gaseous products from the liquid electrolyte. The electrode layer allows for the diffusive transport of the reactant gas to the catalyst surface and the resulting product gas away from the catalyst surface.

In embodiments pertaining to forming the electrode layer, the method can comprise electrodeposition of a catalyst on the catalyst side of an electrically conducting porous layer. In one embodiment, the catalyst can be Pt, Ru, Cu, Ti, Ni, or Cu—Br. In an embodiment, the electrically conducting porous layer is a hydrophobic porous layer impregnated with carbon black particles, yielding a layer that is hydrophobic and electrically conducting. In one embodiment, the hydrophobic porous layer is made from a hydrophobic material such as polytetrafluoroethylene (PTFE).

In an embodiment, a hybrid electro-catalyst for high selectivity production of $C_2H_4$ from $CO_2$ is provided. In an embodiment, the hybrid electro-catalyst is copper oxide-copper bromide ($Cu_2O$—CuBr). In an embodiment, the hybrid film catalysts are formed by electrodeposition of a hybrid $Cu_2O$—CuBr film on a gas diffusion layer (GDL) support material under controlled voltage. In an embodiment, the electrodeposition comprises using water-soluble copper salts solutions, a selected complexing agent, and an adjusted pH to target a simultaneous deposition of cubic nanostructures composed of copper, oxygen and a halogen. The pH plays a significant role in balancing the ratio of oxygen to halogen into the film. Thicknesses are adjusted by controlling the temperature of the aqueous electrolytic bath and the electric charge passed under voltage control. In an embodiment, optimal preparation times span between 30 to 35 min.

The foregoing has outlined rather broadly the features of the present disclosure in order that the detailed description that follows may be better understood. Additional features and advantages of the disclosure will be described hereinafter, which form the subject of the claims.

BRIEF DESCRIPTION OF THE DRAWINGS

In order that the manner in which the above-recited and other enhancements and objects of the disclosure are obtained, a more particular description of the disclosure briefly described above will be rendered by reference to specific embodiments thereof which are illustrated in the appended drawings. Understanding that these drawings depict only typical embodiments of the disclosure and are therefore not to be considered limiting of its scope, the disclosure will be described with additional specificity and detail through the use of the accompanying drawings in which:

FIG. 23A-23B show the film chemical composition of N, L9, and L7 films and their respective SEM images with marked areas where the chemical analysis was performed ("L" refers to a hybrid film prepared with lactic acid; films prepared without lactic acid are referred to as "N" films because the electrolytic bath contains nitrate salts; for films prepared with lactic acid (L-films) the electrolytic bath pH was adjusted to pH 9 or pH 7; the respective films are named L9 or L7 respectively);

DETAILED DESCRIPTION

The particulars shown herein are by way of example and for purposes of illustrative discussion of the preferred embodiments of the present disclosure only and are presented in the cause of providing what is believed to be the most useful and readily understood description of the principles and conceptual aspects of various embodiments of the disclosure. In this regard, no attempt is made to show structural details of the disclosure in more detail than is necessary for the fundamental understanding of the disclosure, the description taken with the drawings making apparent to those skilled in the art how the several forms of the disclosure may be embodied in practice.

The following definitions and explanations are meant and intended to be controlling in any future construction unless clearly and unambiguously modified in the following examples or when application of the meaning renders any construction meaningless or essentially meaningless. In cases where the construction of the term would render it meaningless or essentially meaningless, the definition should be taken from Webster's Dictionary 3$^{rd}$ Edition.

Figure 1:
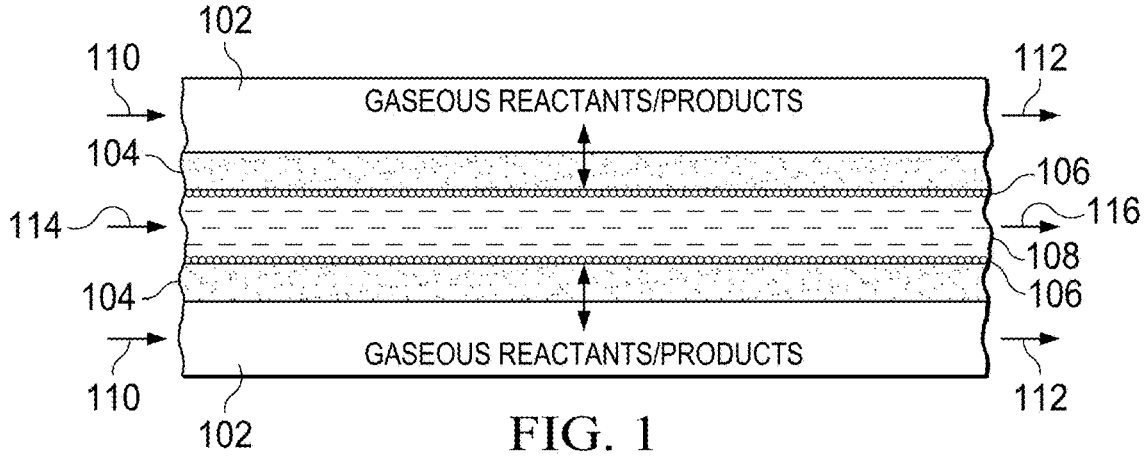
FIG. 1 is a cross-section view of a single cell reactor.

As shown in FIG. 1, the reactor includes a porous layer 104 that consists of an electrically conducting material that allows gases, but not liquids, to pass through. This preference to gas flow and resistance to liquid flow are created by using a porous layer 104 that is made from a hydrophobic material such as polytetrafluoroethylene (PTFE). A porous PTFE layer impregnated with carbon black particles yields a layer that is hydrophobic and electrically conducting. Such materials, commonly known as gas diffusion layers (GDL) were developed for hydrogen fuel cells.

Methods of depositing Pt catalyst on the surface of the GDL were also developed by the fuel cell industry. These methods include spray coating nanoparticles, chemical vapor deposition, sputtering, and incipient wetness impregnation. These catalytic surfaces maintain a hydrophobic nature, which is beneficial in the operation of fuel cells that use solid electrolytes.

Figure 2:
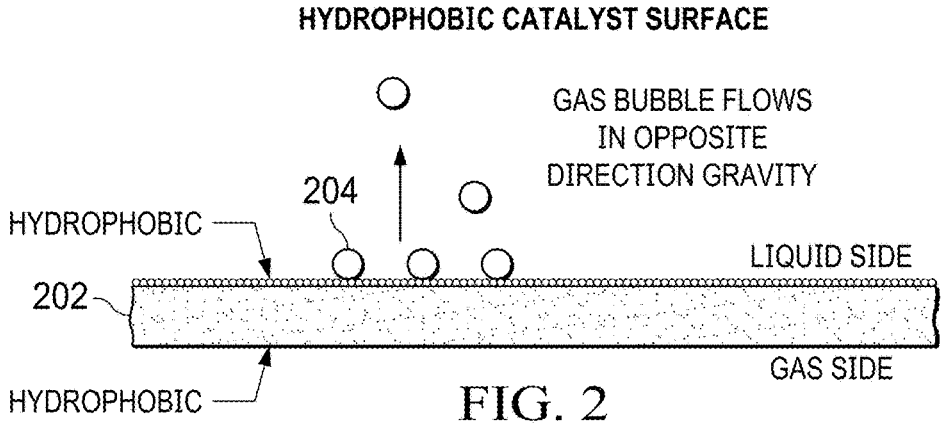
FIG. 2 show an application of traditional catalyst-GDL to electrolysis reaction.

GDLs with a Pt coating 202 could also be applied to reactions that generate gaseous products on the catalyst surface (for example, during water splitting when $H_2$ and $O_2$ gaseous are formed). FIG. 2. However, due to the hydrophobic nature of the catalyst surface, the products form bubbles 204 that then mix with the liquid electrolyte, as shown in FIG. 2. This creates two difficulties. First, the gaseous products 204 must be separated from the electrolyte, which is not simple for a continuous flow reactor. Second, the bubbles 204 have a tendency to "stick" to the surface until they've reached a large size. These bubbles 204 block access of electrolyte to the catalyst surface, thereby reducing production capacity of the cell.

Referring to FIG. 1, a cross-section for a single cell reactor is depicted. The reactor comprises an electrolyte channel 108 sandwiched between two gas channels 102, two electrode layers separate the electrolyte channel 108 and the two gas channels 102 respectively, each of the two electrode layers is hydrophilic on the catalyst side and hydrophobic on the gas side. Each of the gas channels 102 have a gas inlet 110 to input gaseous reactants and a gas outlet 112 to output gaseous reactants and gaseous products, and the electrolyte channel 108 has an electrolyte inlet 114 and an electrolyte outlet 116 to make the electrolyte flow through the electrolyte channel.

The electrode layer is hydrophilic on the catalyst side and hydrophobic on the gas side. These different surface properties promote the transport of product gases formed at the catalyst 106 through the electrode layer to the gas side. The electrode layer comprises electrodeposition of a catalyst 106 on the catalyst side of an electrically conducting porous layer. The porous layer 104 consists of an electrically conducting material that allows gases but not liquids to pass through. This preference to gas flow and resistance to liquid flow are created by using a porous layer 104 that is made from a hydrophobic material containing Fluoropolymers such as polytetrafluoroethylene (PTFE). A porous PTFE layer impregnated with carbon black particles yields a layer that is hydrophobic and electrically conducting. Such materials, commonly known as gas diffusion layers (GDL) were developed for hydrogen fuel cells.

Figure 3:
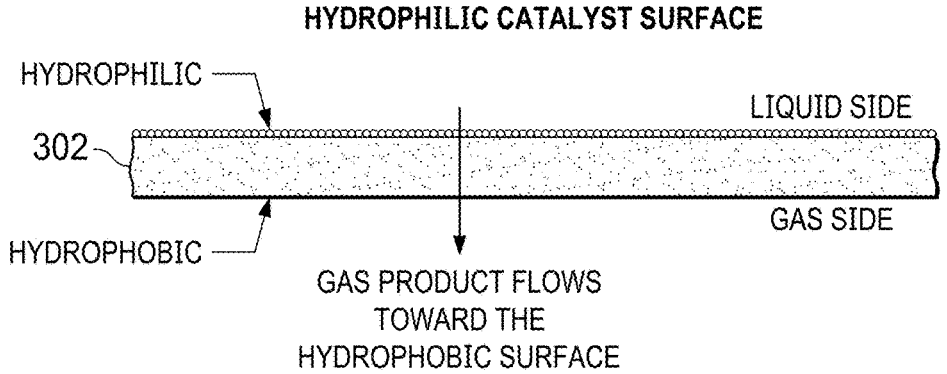
FIG. 3 show an application of catalyst-GDL element in accordance with embodiments disclosed herein to electrolysis reaction.

To solve the problem related to the hydrophobic nature of the catalyst surface during the reaction, a catalyst is deposited on the GDL surface 302 via electrodeposition, such that the GDL surface does not form gaseous product bubbles. FIG. 3. Rather, referring to FIG. 3, the gaseous products were transported to the gas side of the GDL. Upon further examination, the electrodeposited surface is found to be hydrophilic, while the backside of the GDL remained hydrophobic. During the formation of the gaseous products, the surface draws liquid in rapidly (due to its hydrophilic nature) and creates a pressure gradient that forces the gas to the hydrophobic region that is devoid of electrolyte.

This new catalyst GDL 302 should allow for higher reaction rates (due to a lack of bubble attachment on the surface), simpler reactor designs as no gas separation from the electrolyte is needed, and gravity independent operation (important for application in spacecraft, such as oxygen generation from water or $CO_2$).

In an embodiment, the catalyst can be Pt, Ru, Cu, Ti, Ni, or Cu—Br. The catalyst is electrodeposited on a surface of a GDL to form a hydrophilic surface. In an embodiment, the amount of catalyst deposited by electrodeposition is critical. If the catalyst layer is too thick, the GDL pores become clogged and block the gas from exiting. In that case, bubbles will form on the surface of the GDL as with a hydrophobic catalyst.

In an embodiment, the electrodeposition method used Pt. In various embodiments, the same procedure can be repeated for other metals (using a different starting compound).

Pre-treatment: GDL Sigracet® 35 BC was selected as a substrate from commercial GDLs for catalytic Pt films. The surface of the GDL is very hydrophobic. Before electrodeposition, the GDL was immersed in a mixture of isopropanol and water in a ratio 1:2.

Small GDL (surface area 4.5 $cm^2$): The Pt electrodeposition protocol was performed in a glass beaker with 38 mM of $H_2PtCl_6.6H_2O$ in acid solution (0.1M $H_2SO_4$) at 50° C. and an applied potential of −0.5 V which was kept until reaching 4.5 $C/cm^2$ of film formation. All potentials for the potentiostatic electrodeposition were measured with respect to the Ag/AgCl electrode. Pt foil was used as counter electrode.

Figure 4A:
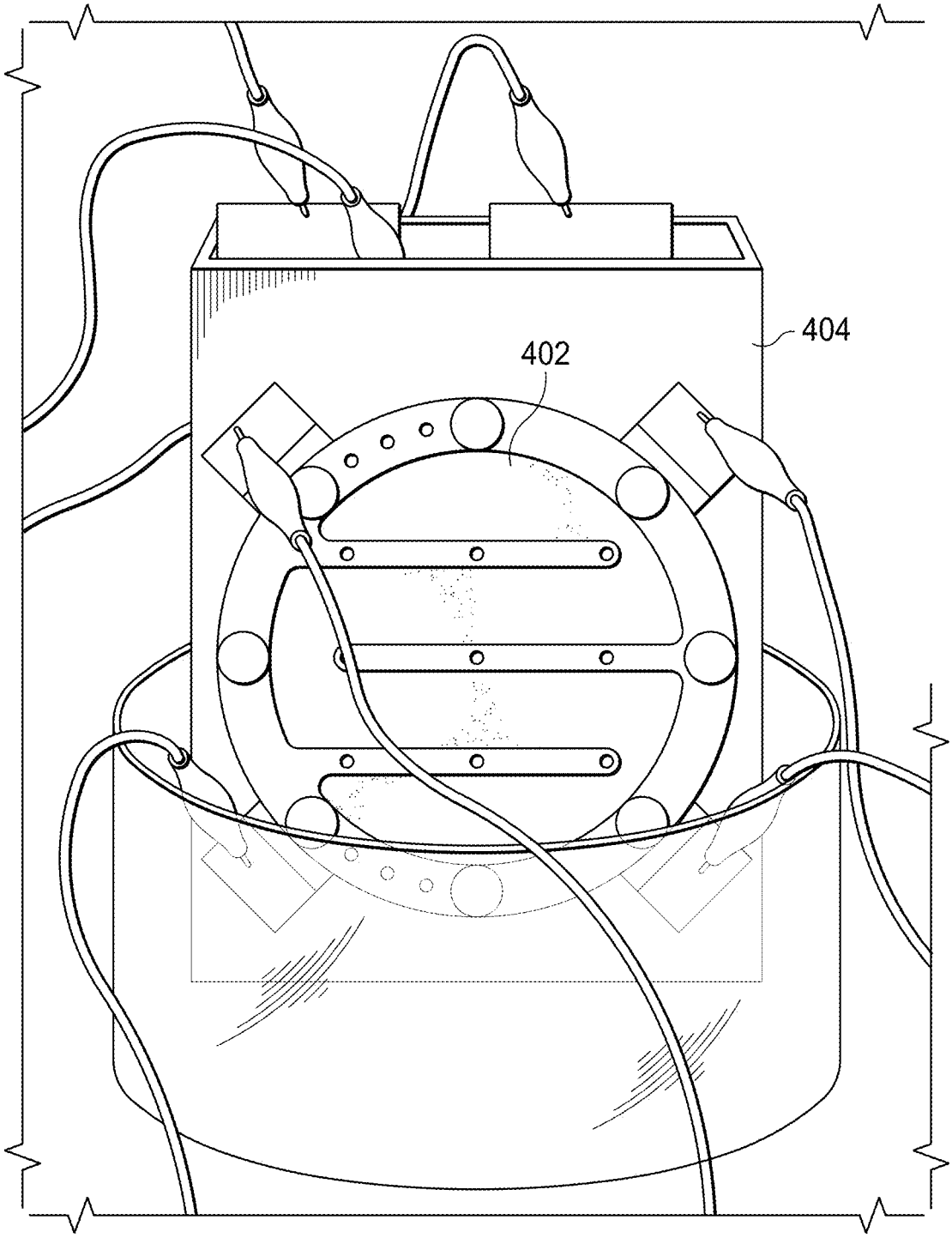
FIGS. 4A and 4B shows electrodeposition of Pt on a Sigracet® 35 BC GDL.
Figure 4B:
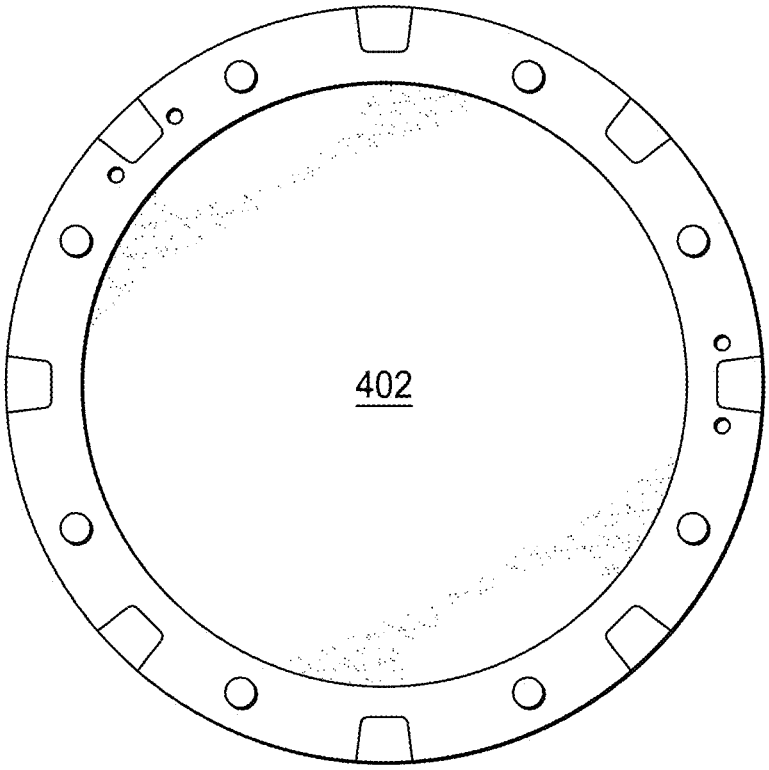

Large GDL 402 (surface area 105 $cm^2$): The Pt electrodeposition protocol was performed in a custom cell 404 (FIGS. 4A and 4B) with 10 mM of $H_2PtCl_6$. $6H_2O$ in acid solution (0.1M $H_2SO_4$) at 50° C. and an applied potential of −0.5 V was maintained until reaching 2.5 $C/cm^2$ of film formation. Stainless foil was used as counter electrode.

Testing

The catalyst-coated GDL was characterized and tested in a batch cell and a continuous flow cell.

Figure 5A:
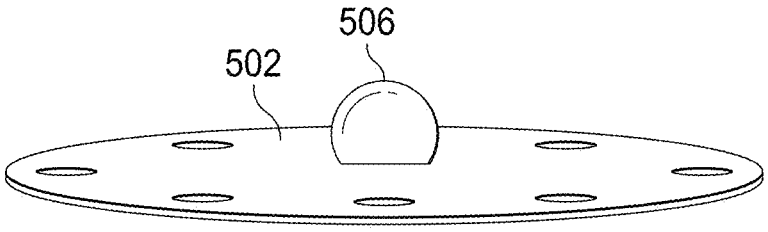
FIGS. 5A and 5B shows photographs of a liquid drop on a commercial Pt-GDL (FIG. 5A) and electrodeposited Pt-GDL (FIG. 5B)
Figure 5B:
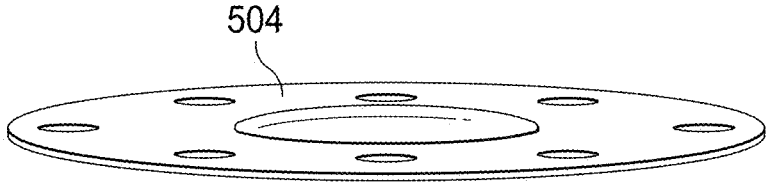

Characterization of the wetting surfaces was performed by observing the contact angle at the solid/liquid phase. A liquid was dropped on surface of catalyst. The commercial Pt-GDL 502 (4 $mg/cm^2$ Pt, FuelCellsETC) shows the liquid poorly wets the surface and forms a droplet 506 (FIG. 5A). The electrodeposited Pt-GDL 504 is easily wetted (FIG. 5B). A lower contact angle indicates greater wettability.

Figure 6A:
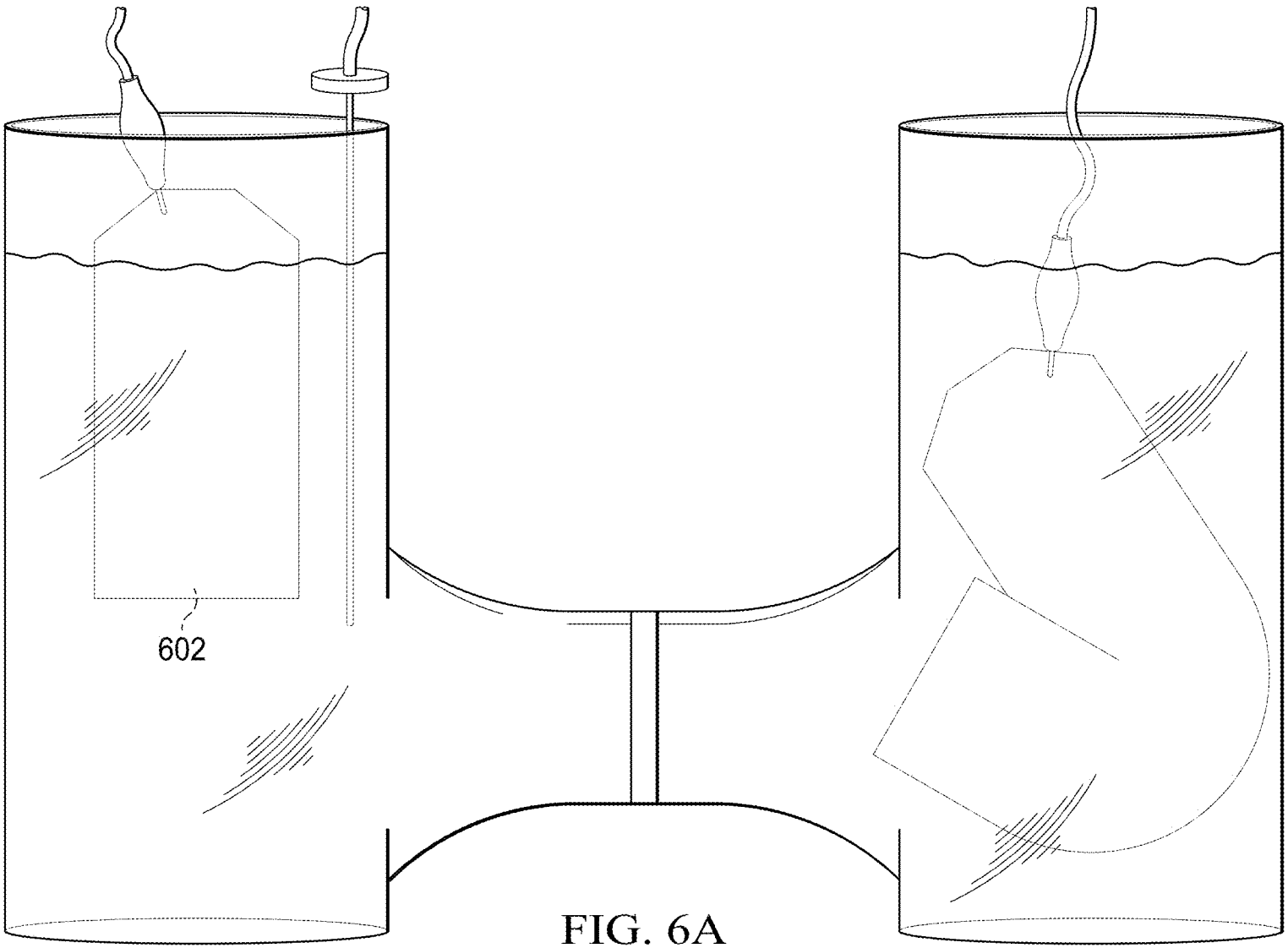
FIGS. 6A and 6B shows bubbles formation at the back side of Pt-GDL during water electrolysis.
Figure 6B:
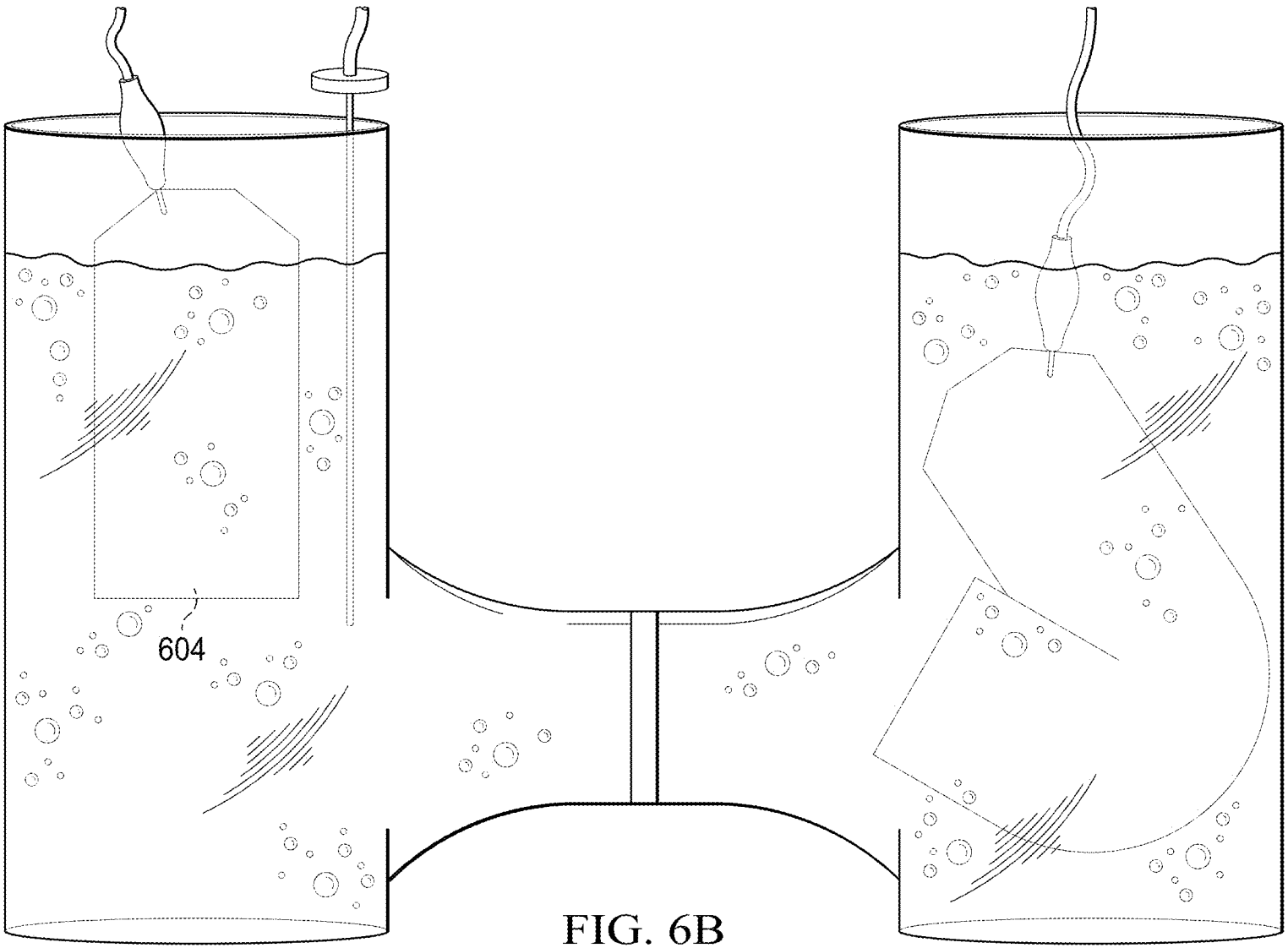

To test the catalyst-coated GDL, a catalyst was subjected to water electrolysis in 0.1 M NaHCO.sub.3 electrolyte at −0.4 V. During water electrolysis, bubbles formed at the back of the GDL 604 (FIG. 6B). No bubbles were seen at the face of catalyst-coated GDL 602 (FIG. 6A). In another compartment containing a Pt electrode, a significant amount of oxygen bubbles was seen, indicating that the reaction is occurring.

Figure 7:
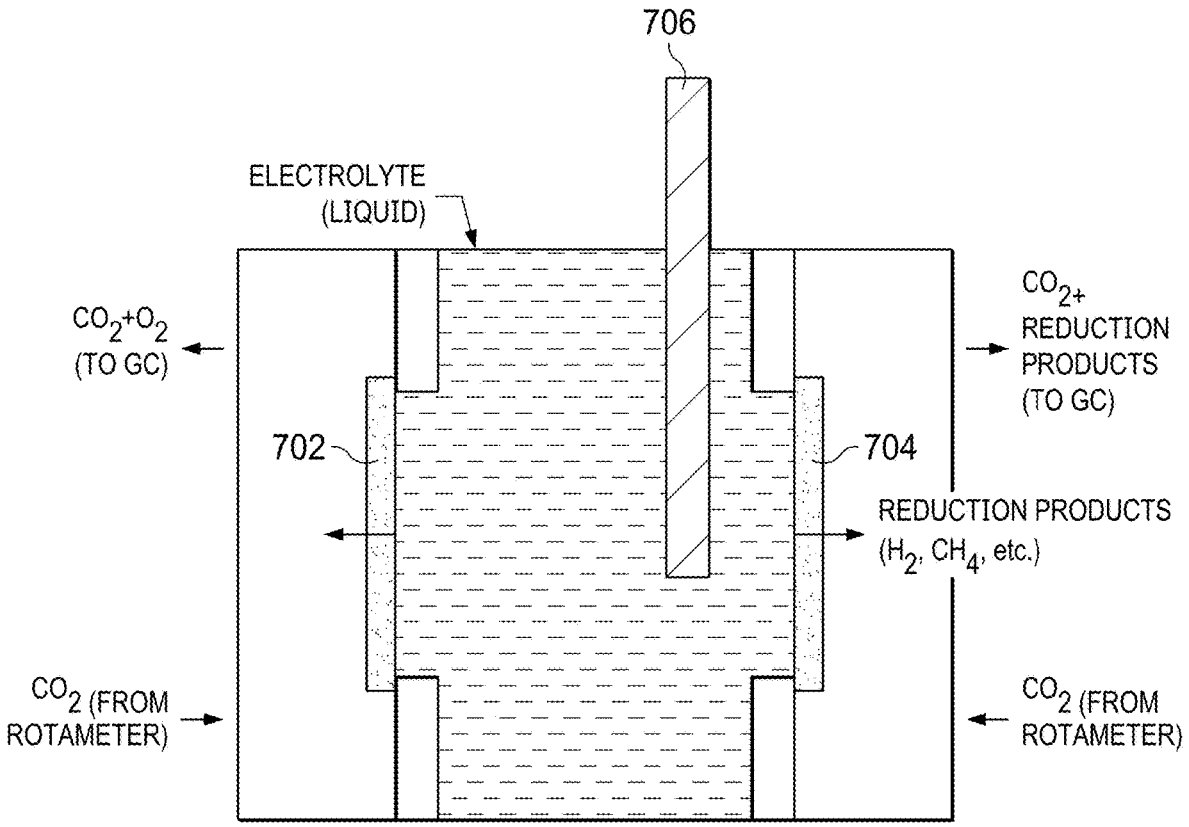
FIG. 7 shows a batch cell test configuration.
Figure 8:
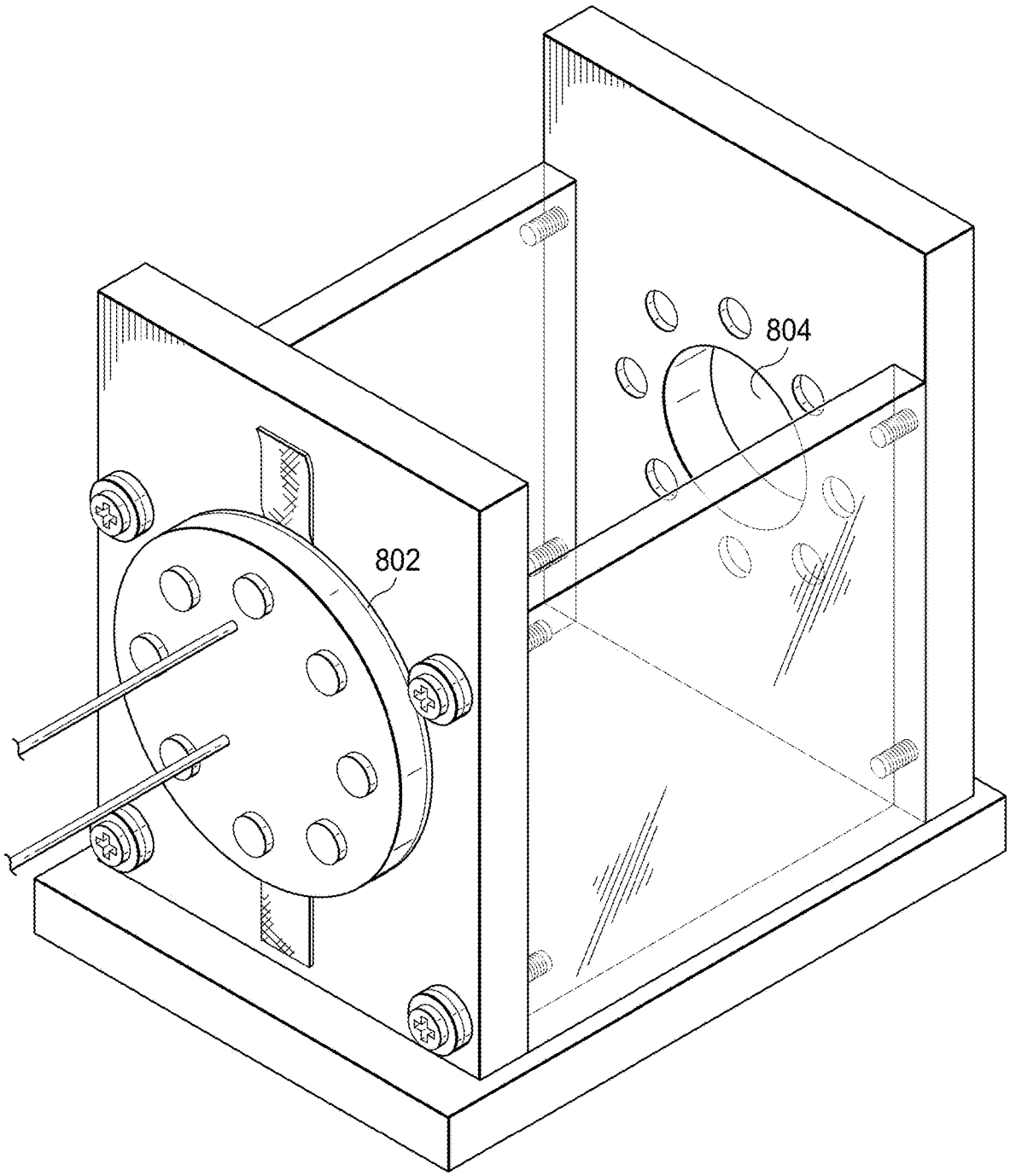
FIG. 8 shows a fabricated batch cell.

The catalyst-coated GDLs were tested in a batch cell, so that the GDL surface could be observed (FIG. 7 and FIG. 8). The reactors were used to perform water electrolysis ($H_2O \rightarrow H_2+5O_2$) and $CO_2$ electrolysis ($CO_2+2H_2O \rightarrow CH_4+20_2$). A commercial GDL, Sigracet® 35 BC, was used for these embodiments. In an embodiment, other GDL that is coated with Teflon can be used. Examples of these GDLs include but are not limited to carbon cloth and carbon paper. The anode GDL 702 and 802 was coated with Pt, the cathode GDL 704 and 804 with Cu, both were performed using electrodeposition.

Figure 9:
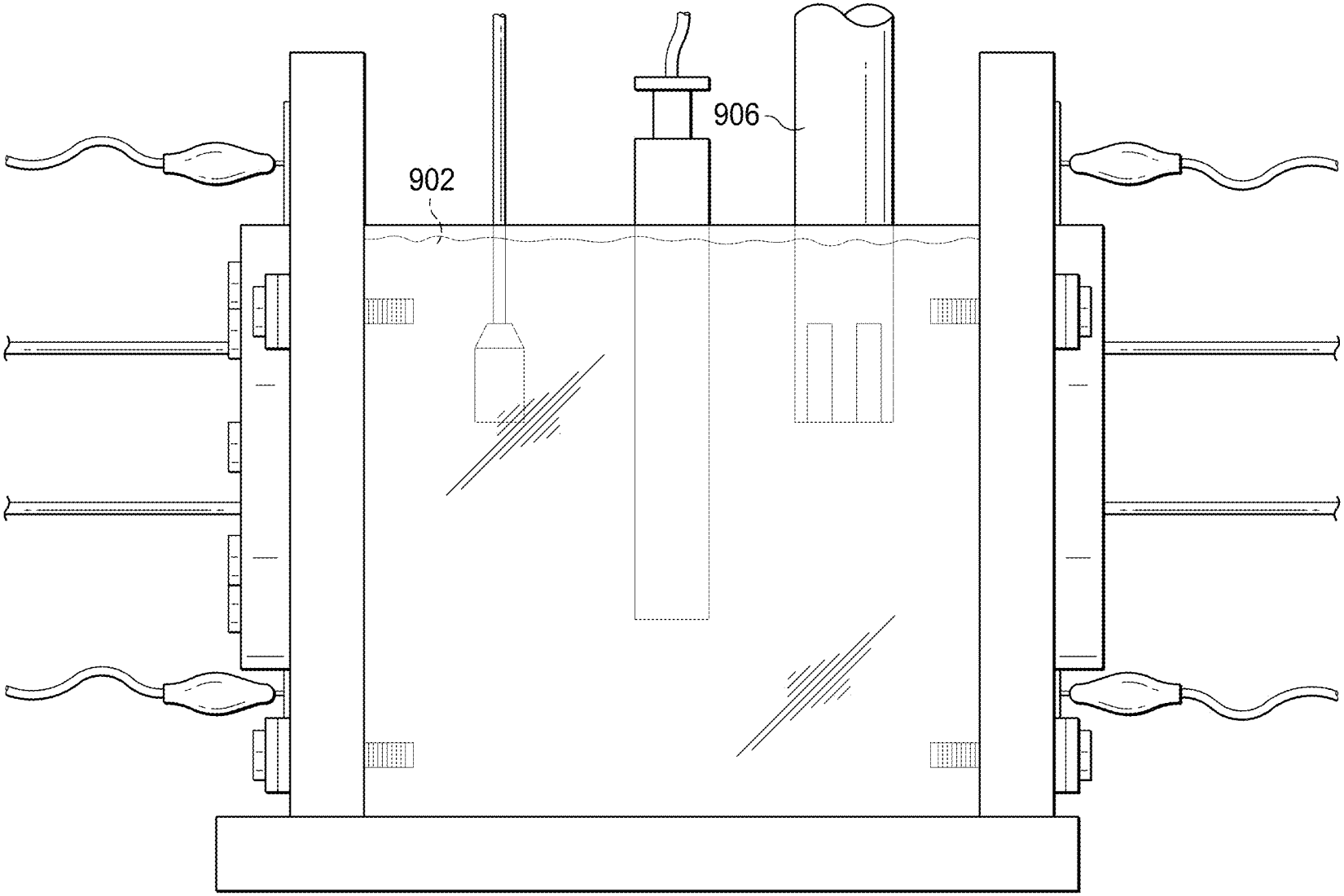
FIG. 9 shows operating cell for cathode at −3V.
Figure 10:
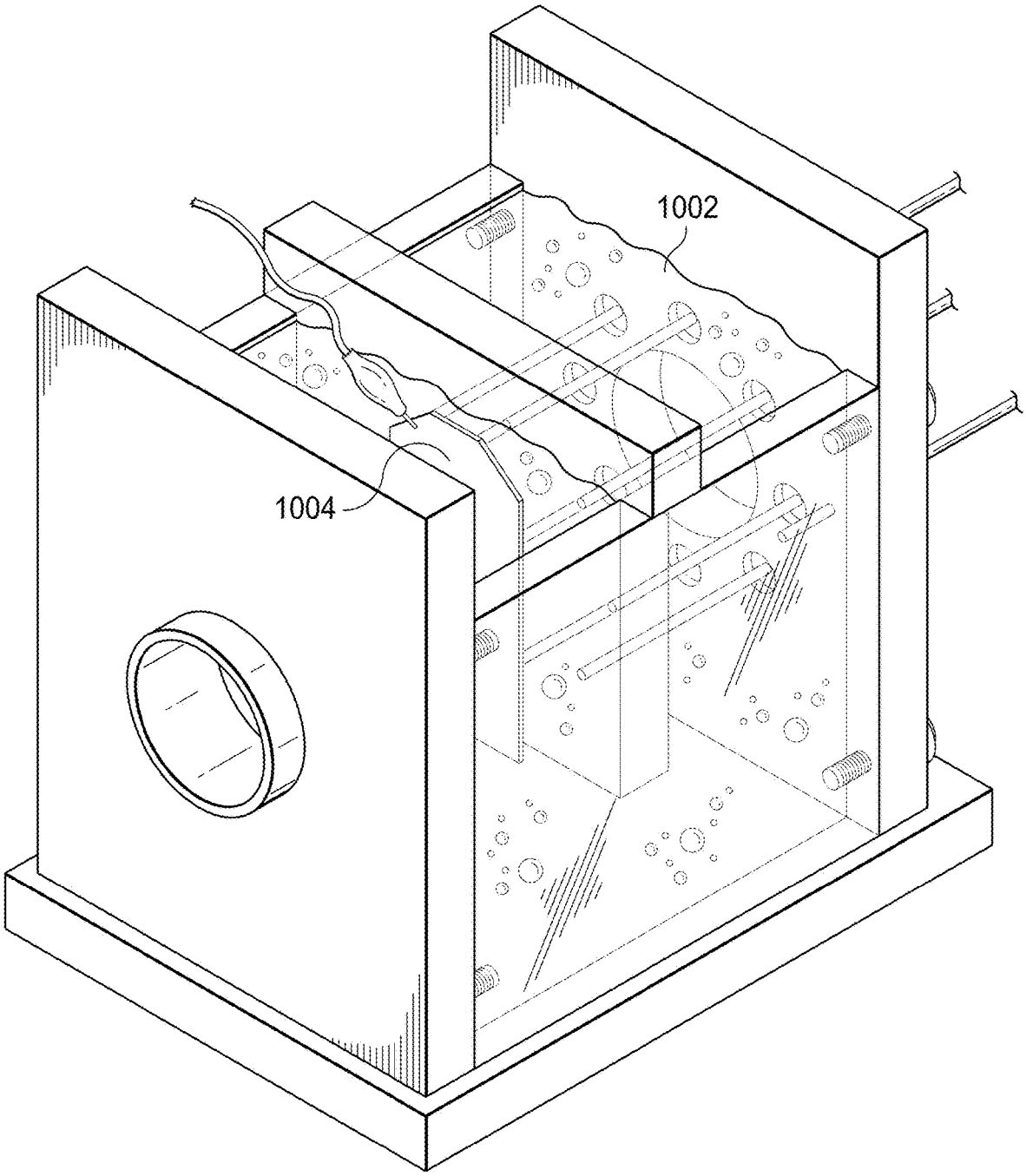
FIG. 10 shows operating cell with Pt foil cathode at −3V.
Figure 11A:
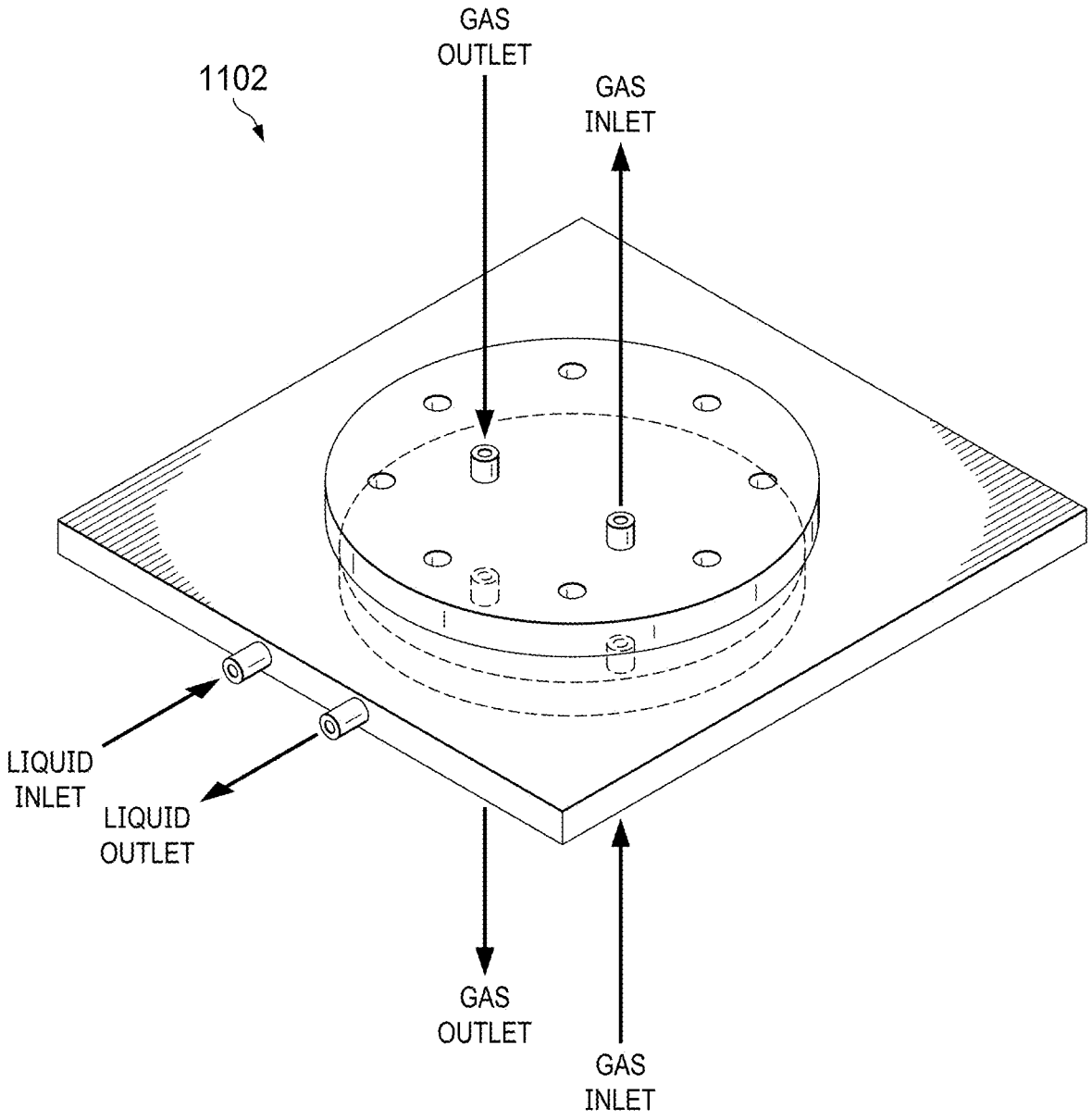
FIG. 11A-11B show a continuous flow reactor solid model.
Figure 11B:
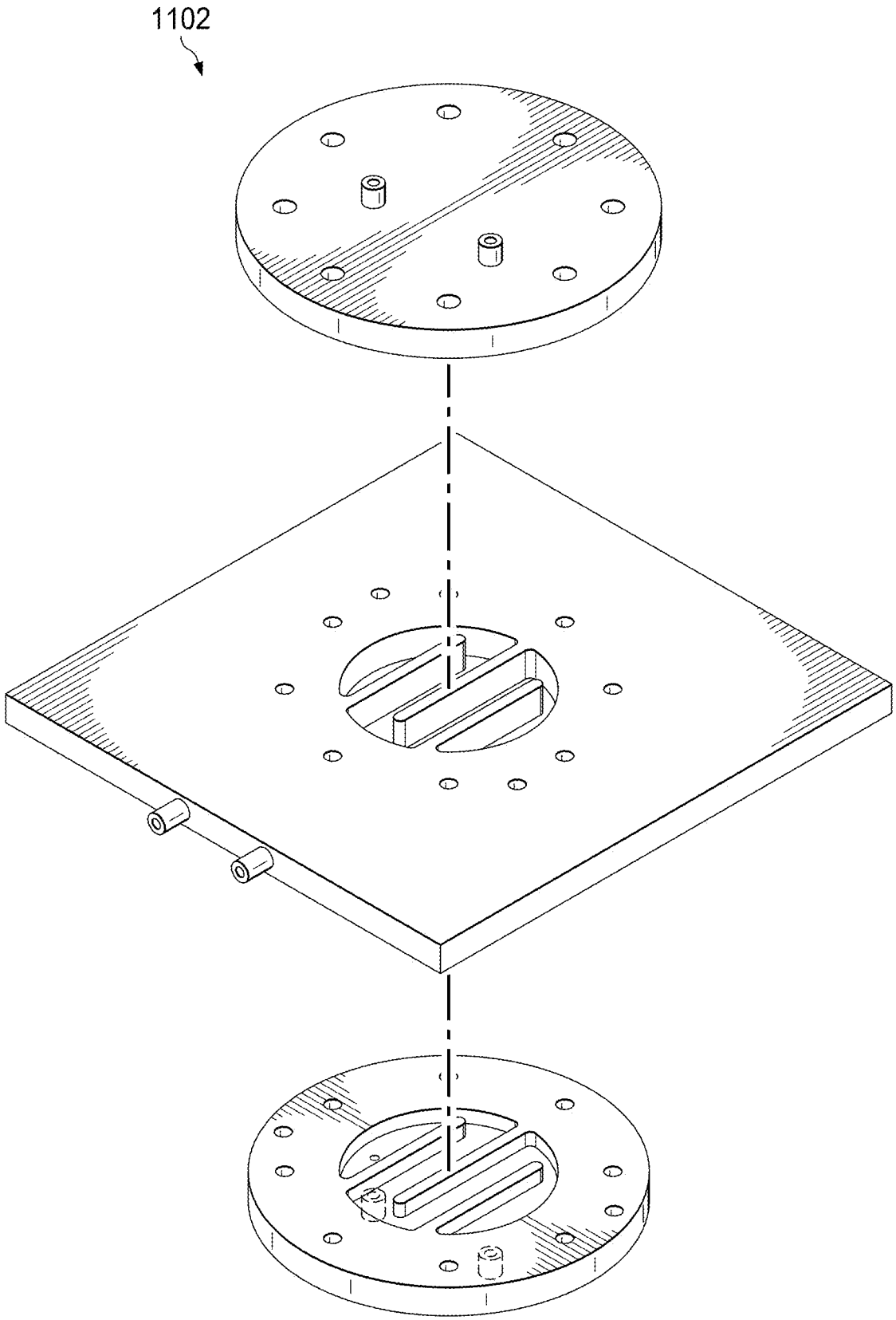
Figure 12A:
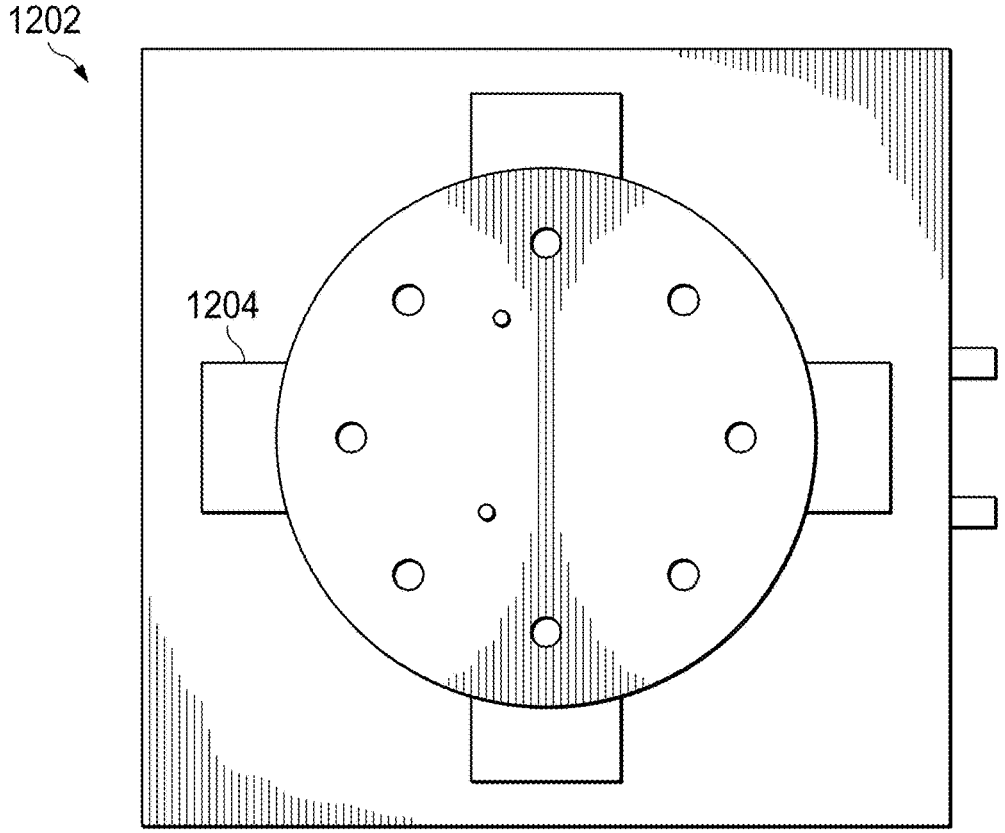
FIG. 12A-12B show a continuous flow reactor and GDL used for testing.
Figure 12B:
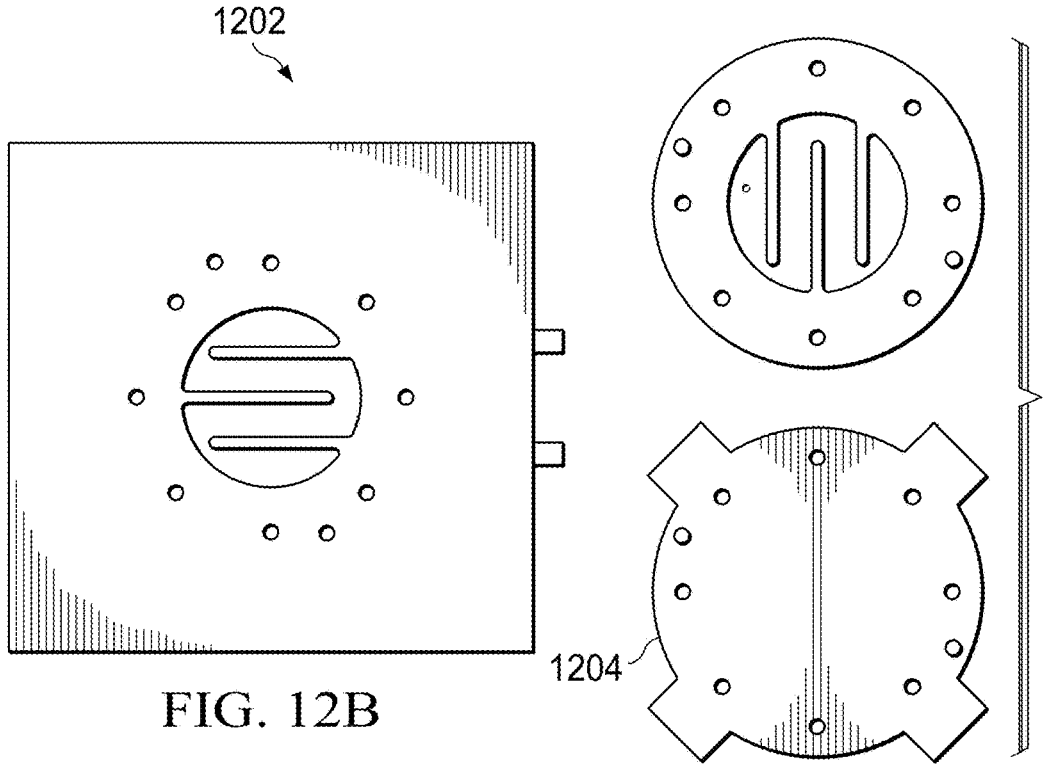

The cell was tested at room temperature with 1M KOH electrolyte. A cathode potential of −3V relative to an Ag/AgCl reference electrode 706 and 906 was used. A low flow rate of $CO_2$ gas was passed over the gas side of each GDL and then directed into a gas chromatograph (GC) for quantification. FIG. 9 shows that the electrolyte solution 902 remains free of bubbles during operation. A current density around 50 $mA/cm^2$ was measured, and $H_2$ and hydrocarbon gases were detected by the GC. In comparison, the same experiment was repeated with the cathode GDL replaced with Pt foil 1004. The same potential and comparable current density was measured, yet the electrolyte 1002 became cloudy due to the $H_2$ bubbles produced (FIG. 10).

Similar experiments were performed with a single cell continuous flow electrochemical reactor 1102 and 1202 (FIGS. 11A-11B and FIG. 12A-12B) where the electrolyte was pumped continuously into a cell comprising a single GDL 1204. Significant current densities were measured, no gas bubbles in the electrolyte stream were detected, and product gases were detected by GC.

Incorporation into a Chemical Manufacturing Process

Figure 13:
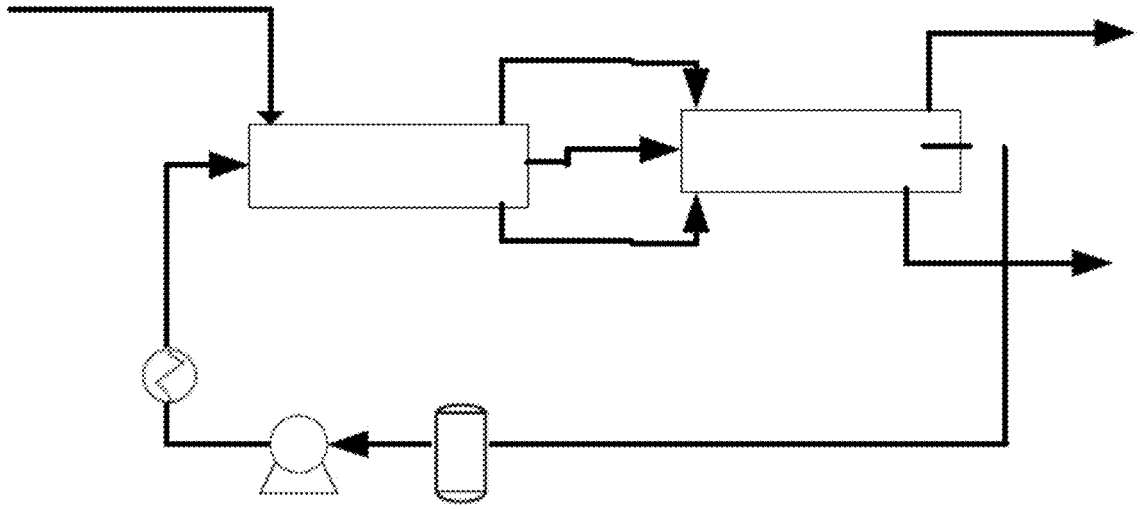
FIG. 13 shows a process for purifying product gas by selectively reacting hydrogen and oxygen with a fuel cell.
Figure 14:
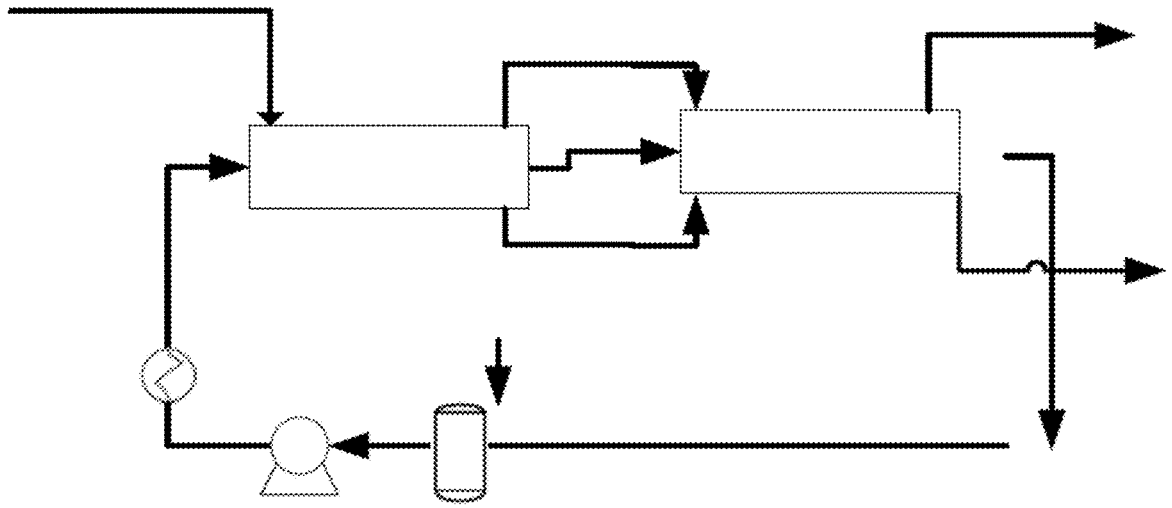
FIG. 14 shows a process for generation of hydrocarbon gases from $CO_2$ and water.

In an embodiment, the reactor described can be used with any electrochemical process producing/consuming gases utilizing a liquid electrolyte. In an embodiment, the liquid electrolyte contains water, which is often electrolyzed in a side reaction. This leads to undesired hydrogen and oxygen byproducts. For renewable energy applications where the reactor is powered by electricity produced by wind or solar energy to produce chemicals, the hydrogen byproduct may be stored. During periods of low sunlight or wind, the stored hydrogen may be used to generate electricity through a fuel cell or gas turbine to power the reactor. Alternatively, the hydrogen can be selectively removed from the cathode-side product stream by using a fuel cell as shown in FIG. 13. In the process described in FIG. 13, the fuel cell may be the same reactor design as described in this disclosure using a Pt and/or Ni catalyst on the anode and cathode side. The electricity generated by the fuel cell may be used to partially power the upstream electrolysis reactor. The same electrolyte stream used by the electrolysis reactor may also be used by the fuel cell reactor. One specific example of the application of the process would be the generation of hydrocarbon gases like ethylene or methane from $CO_2$ and water (FIG. 14).

Figure 28:
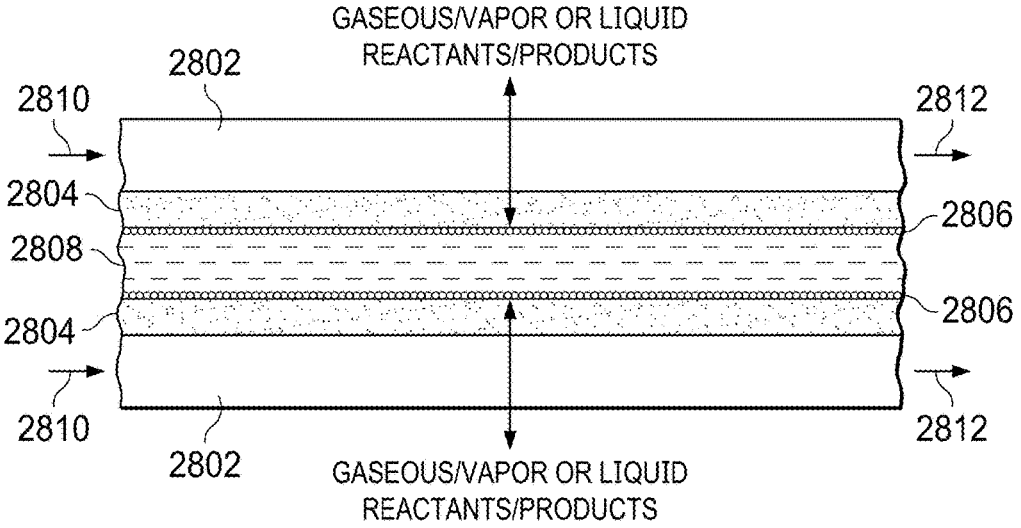
FIG. 28 shows a reactor using a solid electrolyte. The liquid electrolyte of FIG. 14 is replaced with a solid electrolyte.

In an embodiment, the liquid electrolyte used in the reactor may be replaced with a solid electrolyte. FIG. 28 shows a schematic of the reactor using a solid electrolyte to generate ethylene from $CO_2$ and water. The reactor comprises a solid electrolyte 2808 sandwiched between two fluid channels 2802, two electrode layers separate the solid electrolyte 2808 and the two gas channels 2802 respectively. Each of the gas channels 2802 have a gas inlet 2810 to input gaseous reactants and a gas outlet 2812 to output gaseous reactants and gaseous products. The reactor includes a porous layer 2804 with a catalyst 2806 electrodeposited on the surface facing the solid electrolyte 2808. The reactor can be applied to the production of ethylene using either anion (FIG. 29) or cation (FIG. 30) exchange membranes.

In various embodiments, the reactor could be applied to a variety of electrochemical reactions by changing the reactants and catalysts used. Examples include but are not limited to:

1. Acid or alkaline liquid fuel cells using Pt or Ni catalysts;
2. Splitting of water to make $H_2$ and $O_2$ for energy storage or oxygen generation in micro-gravity environments;
3. Photo-driven water splitting with photo-cathode and/or photo-anode;
4. Reduction of $CO_2$ to hydrocarbon gases or liquid products;
5. Lithium air batteries;
6. Synthesis of ammonia from $H_2O$ and $N_2$; and
7. Synthesis of $H_2O_2$ from oxygen and water.

Hybrid Electro-Catalyst

To further improve the performance of the electrode layer, a hybrid electro-catalyst for high selectivity production of $C_2H_4$ from $CO_2$ is discussed herein. In an embodiment, hybrid film catalysts are electrodeposited on gas diffusion layer (GDL) support material under controlled voltage and using water-soluble copper salts solutions, a selected complexing agent, and an adjusted pH to target a simultaneous deposition of cubic nanostructures composed of copper, oxygen, and a halogen. The pH plays a significant role in balancing the ratio of oxygen to halogen into the film. Thicknesses are adjusted by controlling the temperature of the aqueous electrolytic bath and the electric charge passed under voltage control. In an embodiment, optimal preparation times can span from 30 to 35 min.

Table 1 presents the conditions used for 3 types of hybrid film preparation (Films 2-4) as well as the reference film consisting of a pristine $Cu_2O$ composition (Film 1). For film type 2, two solutions have been used: (1) 0.2 M $CuSO_4$+2 M lactic acid adjusted to pH 9 and (2) same as solution (1) but with the addition of 0.1 M NaBr. The electrodeposition starts by using solution (1) for 15 min followed by the addition of a 5% in volume of solution (2) to the cathode compartment and continuing the electrodeposition for another 5 min, i.e., totaling 20 min of polarization at −0.4 V. For films 3 and 4, only solution (2) is used and the film growth was performed for 15 and 20 min respectively. The films 2-4 are predominantly made of $Cu_2O$ component and containing some CuBr to attract $CO_2$ to the interface.

TABLE 1

| Hybrid $Cu_2O$/CuBr films prepared with lactic acid |
|---|
| 1. $Cu_2O$ (L-ED 15): ED on GDL (35 BC) at −0.4 V (15 min, 60° C.) in 0.2M $CuSO_4$•$xH_2O$ + 2M $CH_3CH(OH)CO_2H$ |
| 2. $Cu_2O$/CuBr (L-ED15/5): ED on GDL (35 BC) at −0.4 V (15 min, 60° C.) in 0.2M $CuSO_4$•$xH_2O$ + 2M $CH_3CH(OH)CO_2H$, followed by another 5 min ED after addition of 5% in volume of 0.2M CuSO4•xH2O + 2M C3H6O3 + 0.1M NaBr |
| 3. $Cu_2O$—CuBr (L-ED 15): ED on GDL (35 BC) at −0.4 V (15 min, 60° C.) in 0.2M $CuSO_4$•$xH_2O$ + 2M $CH_3CH(OH)CO_2H$ + 0.1M NaBr |
| 4. $Cu_2O$—CuBr (L-ED 20): ED on GDL (35 BC) at −0.4 V (20 min, 60° C.) in 0.2M $CuSO_4$•$xH_2O$ + 2M $CH_3CH(OH)CO_2H$ + 0.1M NaBr |

As all these films were prepared from an electrolyte containing lactic acid, an "L" is used to distinguish them from other hybrid films prepared at pH 6 without lactic acid. In relation to the nomenclature for the hybrid films, those prepared without lactic acid are named as "N" films because the electrolytic bath contains nitrate salts. They are prepared at −0.4 V in 0.1 M $Cu(NO_3)_2.5H_2O$+0.1 M $NaNO_3$+0.17 M NaBr. Films in which the two components are electrodeposited simultaneously are called $Cu_2O$—CuBr while those with the bromide salt formed on pre-grown $Cu_2O$ are named as $Cu_2O$/CuBr to indicate a sequential electrodeposition.

Lactic acid is known to act as surfactant and complexing agent during the electrodeposition of $Cu_2O$ films. The role as surfactant is to promote the electrochemical growth of preferentially oriented films and depending on the pH of the electrolytic bath, the resulting $Cu_2O$ film can be (100) preferentially oriented at pH 9 or (111) at pH 12 (T. D. Golden, M. G. Shumsky, Y. Zhou, R. A. VanderWerf, R. A. Van Leeuwen and J. A. Switzer, Chem. Mater., 1996, 8, 2499; L. Wang, N. R. de Tacconi, C. Chenthamarakshan, K. Rajeshwar, and M. Tao, Thin Solid Films, 2007, 515, 3090). In an embodiment, a ratio of molar lactic acid to cupric cation, (L)/Cu(II), of 10 (with 2 ML and 0.2 M $CuSO_4$) and a pH=9 (for (100) orientation) was used.

To optimize the composition of the electrodeposited film, the best hybrid film performers are listed in Table 2. Three main films, namely N, L9, and L7 are listed. For those films prepared with lactic acid (L-films), the electrolytic bath pH was adjusted to pH 9 or pH 7 and the respective films are named as L9 or L7 respectively. The film thickness is associated with the electrodeposition time (ED xx means xx min of electrodeposition).

TABLE 2

| Electrocatalytic Films for Electrochemical $CO_2$ Reduction |
|---|
| 1. $Cu_2O$—CuBr (N-ED 15): Simultaneous ED on GDL at −0.4 V (15 min, 60° C.) in 0.1M $Cu(NO_3)_2$•$5H_2O$ + 0.1M $NaNO_3$ + 0.17M NaBr. GDL area = 4.52 $cm^2$. Electrodeposited charge (EDQ) = 4.0 $C/cm^2$. |
| 2. $Cu_2O$ (N-ED 30): ED on GDL at −0.4 V (15 min, 60° C.) in 0.1M $Cu(NO_3)_2$•$5H_2O$ + 0.1M $NaNO_3$. |

TABLE 2-continued

| Electrocatalytic Films for Electrochemical $CO_2$ Reduction |
|---|
| 3. $Cu_2O$ (L-ED 15): ED on GDL at −0.4 V (15 min, 60° C.) in 0.2M $CuSO_4$•$x$H20 + 2M $CH_3CH(OH)CO_2H$(pH 9). EDQ = 0.75 C/cm$^2$. |
| 4. $Cu_2O$ (L9-ED 35): ED on GDL at −0.4 V (15 min, 60° C.) in 0.2M $CuSO_4$•$xH_2O$ + 2M $CH_3CH(OH)CO_2H$(pH 9). EDQ = 4.7 C/cm$^2$. |
| 5. $Cu_2O$/CuBr (L9-ED15-5): Sequential ED on GDL at −0.4 V (15 min, 60° C.) in 0.2M $CuSO_4$•$xH_2O$ + 2M $CH_3CH(OH)CO_2H$(pH 9) followed by 5 min ED after addition of 5% v/v of 0.2M CuSO4•xH2O + 0.1M NaBr +2M CH3CH(OH)CO2H(pH 9). EDQ = 1.2 C/cm$^2$. |
| 6. $Cu_2O$—CuBr (L9-ED 15): Simultaneious ED on GDL at −0.4 V (15 min, 60° C.) in 0.2M $CuSO_4$•$xH_2O$ + 0.1M NaBr + 2M $CH_3CH(OH)CO_2H$(pH 9). EDQ = 1.2 C/cm$^2$. |
| 7. $Cu_2O$—CuBr (L9-ED 20): Simultaneious ED on GDL at −0.4 V (20 min, 60° C.) in 0.2M $CuSO_4$•$xH_2O$ + 0.1M NaBr + 2M $CH_3CH(OH)CO_2H$(pH 9). EDQ = 1.7 C/cm$^2$. |
| 8. $Cu_2O$—CuBr (L9-ED 35): Simultaneious ED on GDL at −0.4 V (35 min, 60° C.) in 0.2M $CuSO_4$•$xH_2O$ + 0.1M NaBr + 2M $CH_3CH(OH)CO_2H$(pH 9). EDQ = 4.5 C/cm$^2$. |
| 9. $Cu_2O$—CuBr (L7-ED$\tau$): Simultaneious ED on GDL at −0.4 V (5 min $\leq \tau \leq$ 40 min, 60° C.) in 0.2M $CuSO_4$•$xH_2O$ + 0.1M NaBr + 2M $CH_3CH(OH)CO_2H$(pH 7). 2.0 $\leq$ EDQ $\leq$ 5.0 C/cm$^2$. |

N = Nitrate;
L = Lactic Acid;
ED = Electrodeposition;
GDL = Gas Diffusion layer (35 BC) of geometric area = 4.52 cm$^2$.

Table 3 provides the exact chemicals, amounts, times, and applied potential.

TABLE 3

| Preparation examples | | | | |
|---|---|---|---|---|
| | Electrodeposition | | | |
| Film | Substrate | Pot (V) or Galv (I) | time (min) | Electrolyte |
| Cu | Cu foil | | | |
| Cu | Cu foil | | | |
| Cu2O—CuBr | Cu foil | −2 | 15 | 0.1M Cu(NO3)2 + 0.1M NaNO3 + 0.17M NaBr |
| Cu2O (NO3−) | GDL 35 BC | I = 0.3 mA/cm2 | 10 | 0.02M Cu(NO3)2 + 0.17M NaNO3 |
| Cu2O (SO4 2−) | GDL 35 BC | I = 0.3 mA/cm2 | 10 | 0.02M Cu(NO3)2 + 0.17M Na2SO4 |
| Cu2O—CuBr | GDL 35 BC Cu foil | −0.3 | 30 | 0.1M Cu(NO3)2 + 0.1M NaNO3 + 0.17M NaBr |
| Cu2O (NO3−) | GDL 35 BC | −0.4 | 30 | 0.1M Cu(NO3)2 + 0.1M NaNO3 |
| Cu2O (SO4 2−) | GDL 35 BC | −0.4 | 30 | 0.1M Cu(NO3)2 + 0.1M Na2SO4 |
| Cu2O—CuBr | GDL 35 BC | −0.3 | 30 | 0.1M Cu(NO3)2 + 0.1M NaNO3 + 0.17M NaBr |
| Electrolysis electrolyte study | | | | |
| Cu2O—CuBr | GDL 35 BC | −0.3 | 30 | 0.1M Cu(NO3)2 + 0.1M NaNO3 + 0.17M NaBr (Charge 11 C/cm2) |
| Cu2O—CuBr | GDL 35 BC | −0.4 | 15 | 0.1M Cu(NO3)2 + 0.1M NaNO3 + 0.17M NaBr (Charge 5.5 C/cm2) |
| Cu2O—CuBr vs Cu2O | | | | |
| Cu2O—CuBr | GDL 35 BC | −0.3 | 30 | 0.1M Cu(NO3)2 + 0.1M NaNO3 + 0.17M NaBr (Charge 8 C/cm2) |
| Cu2O (NO3−) | GDL 35 BC | −0.4 | 30 | 0.1M Cu(NO3)2 + 0.1M NaNO3 |
| Cu2O—CuBr Thickness study | | | | |
| Cu2O—CuBr | GDL 35 BC | −0.3 | 15 | 0.1M Cu(NO3)2 + 0.1M NaNO3 + 0.17M NaBr (Charge 5.5 C/cm2) |
| Cu2O—CuBr | GDL 35 BC | −0.3 | 30 | 0.1M Cu(NO3)2 + 0.1M NaNO3 + 0.17M NaBr (Charge 10 C/cm2) |

TABLE 3-continued

| Preparation examples | | | | |
|---|---|---|---|---|
| | Electrodeposition | | | |
| Film | Substrate | Pot (V) or Galv (I) | time (min) | Electrolyte |
| Cu2O—CuBr Potential study | | | | |
| Cu2O—CuBr | GDL 35 BC | −0.3 | 30 | 0.1M Cu(NO3)2 + 0.1M NaNO3 + 0.17M NaBr (Charge 10 C/cm2) |
| Cu2O—CuBr | GDL 35 BC | −0.4 | 30 | 0.1M Cu(NO3)2 + 0.1M NaNO3 + 0.17M NaBr (Charge 10 C/cm2) |
| Cu2O—CuBr ED Time study | | | | |
| Cu2O—CuBr | GDL 35 BC | −0.4 | 2 | 0.1M Cu(NO3)2 + 0.1M NaNO3 + 0.17M NaBr (Charge 1.3 C/cm2) |
| | | | 5 | (Charge 2.6 C/cm2) |
| | | | 10 | (Charge 5.2 C/cm2) |
| | | | 15 | (Charge 8.2 C/cm2) |
| | | | 30 | (Charge 20.8 C/cm2) |
| Cu2O—CuBr | GDL 35 BC | −0.4 | 15 | 0.1M Cu(NO3)2 + 0.1M NaNO3 + 0.17M NaBr |
| Cu2O—CuBr lactic acid (pH9 adjusted NaOH) | | | | |
| Cu2O-Lac | GDL 35 BC | −0.4 | 15 | 0.2M CuSO4 + 2M Lactic acid |
| Cu2O/CuBr-Lac | GDL 35 BC | −0.4 | 15/5 | 0.2M CuSO4 + 2M Lactic acid (15 min) + 5% V 0.2M CuSO4 + 2M Lactic acid + 0.1M NaBr (5 min) |
| Cu2O/CuBr-Lac | GDL 35 BC | −0.4 | 15 | 0.2M CuSO4 + 2M Lactic acid + 0.1M NaBr |
| Cu2O/CuBr-Lac | GDL 35 BC | −0.4 | 20 | 0.2M CuSO4 + 2M Lactic acid + 0.1M NaBr |

Characterization of Catalyst Film

Scanning electron microscopy (SEM) images establish the formation of perfect crystalline cubic structures during the electrodeposition of the copper-based hybrid films. These crystalline nanostructures evolve independently of one another and form tiny nanocubes at the incipient film growth and become large hybrid cubes of ~2-μm side and finally overlap with one with the other. The X-ray diffraction (XRD) pattern demonstrates the high crystallinity of the resulting films with the dominance of main (100), (110) and (111) faces.

Energy-dispersive X-ray (EDX) spectroscopy provides the element composition of the hybrid catalyst films. Three components are found in any of the electrodeposited films and the ratio of copper to oxygen and halogen are controlled by the electrolytic bath composition.

Figures 15A, 15B:
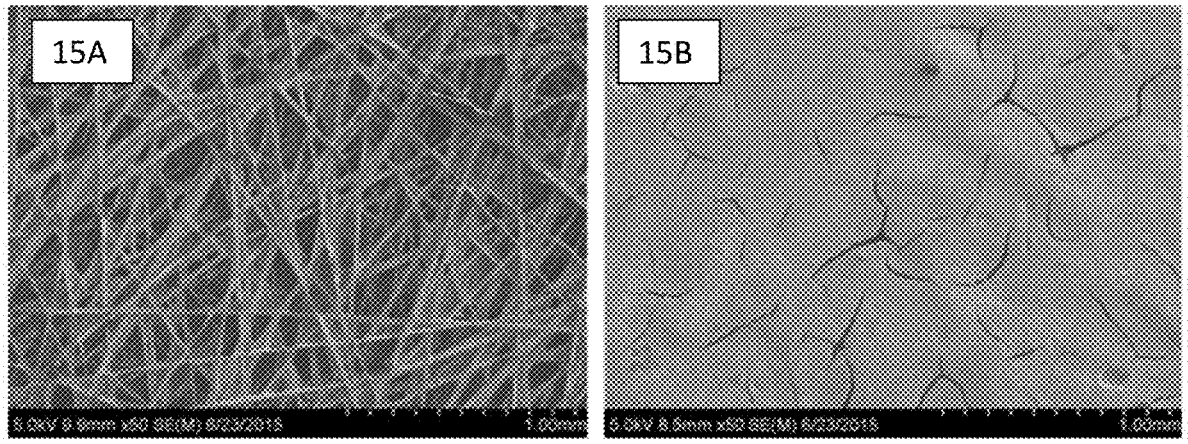
FIG. 15A-15B show SEM images of (15A) back and (15B) top face of a Sigracet® 35BC GDL paper used for film electrodeposition.

All films were electrodeposited on GDL substrates and characterized by SEM, EDX, and XRD. The GDL used was Sigracet® 35BC. This GDL has a paper consistency with a thickness of 325 μm, a weight of 110 g/m$^2$, porosity of 80%, and air gas permeability of 1.5 s. FIGS. 15A and 15B show SEM images of the back (FIG. 15A) and top of the GDL (FIG. 15B). The back surface of the GDL is very open (FIG. 15A) while a film-like look on its top (FIG. 15B) is very convenient for film growth.

Figure 16A:
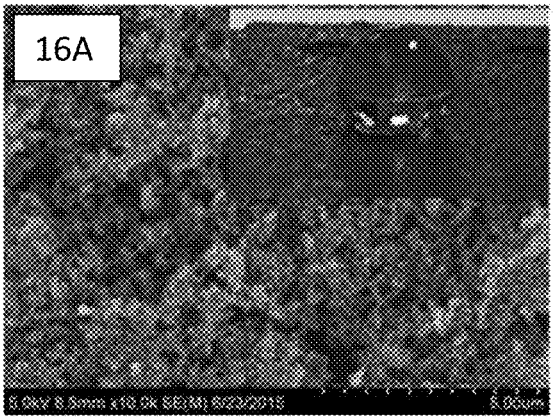
FIG. 16A-16B show SEM comparison of GDL top (16A) before and (a6*b*) after a $Cu_2O$—CuBr (N-ED 30) film was electrodeposited at −0.4 V.
Figure 16B:
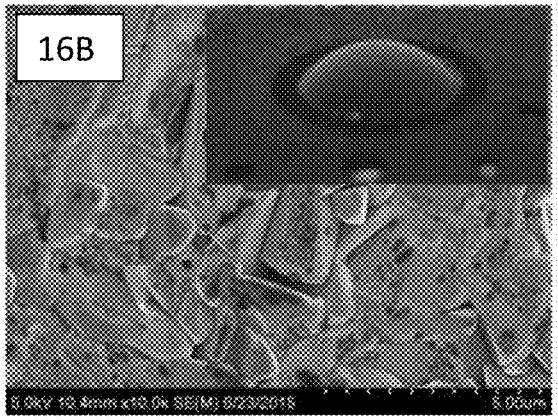

A SEM comparison of the top of GDL without (FIG. 16A) and with a $Cu_2O$—CuBr (N-ED 30) film (FIG. 16B) clearly demonstrates the change from hydrophobicity to hydrophilic properties because of the electrodeposited film. Both SEM images include pictures of a water drop on top of them.

Figure 17A:
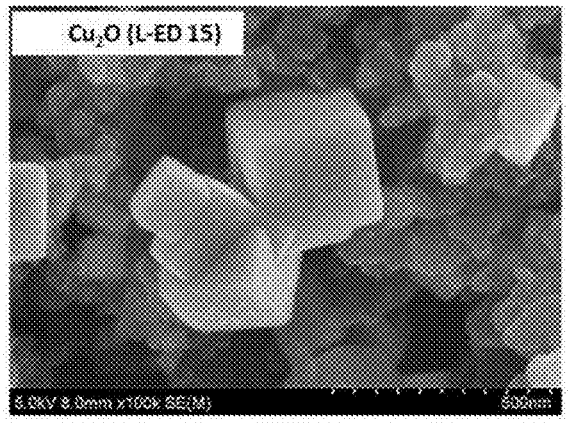
FIG. 17A-17D show SEM images showing the transformation of $Cu_2O$ cubic crystals by exposure to 0.1 M NaBr solution during different electrodeposition times. (17A) $Cu_2O$ grown for 15 min in 0.2 M $CuSO_4 \cdot xH_2O$+2 M $CH_3CH(OH)CO_2H$; (17B) $Cu_2O$/CuBr containing pre-grown $Cu_2O$ (ED 15 min) followed by 5 min in electrodepositing solution with bromide; (17C) $Cu_2O$—CuBr grown for 15 min in 0.2 M $CuSO_4.xH_2O$+2 M $CH_3CH(OH)CO_2H$+ 0.1 M NaBr and (17D) same as (17C) but grown for 20 min. All electrolytic solutions were adjusted at pH 9.
Figure 17B:
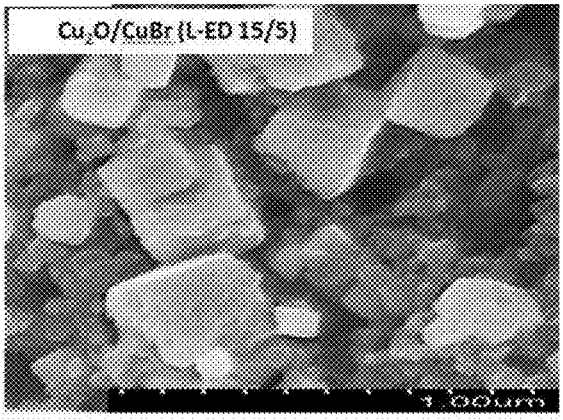
Figure 17C:
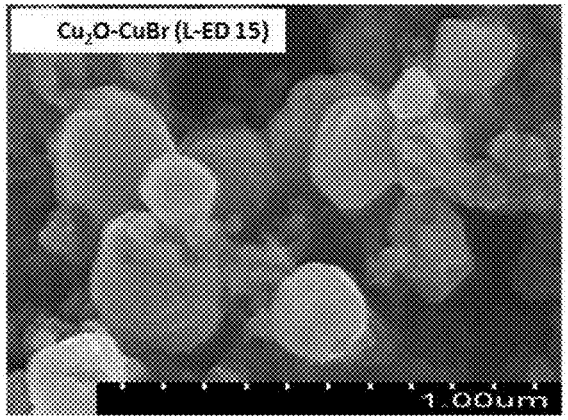
Figure 17D:
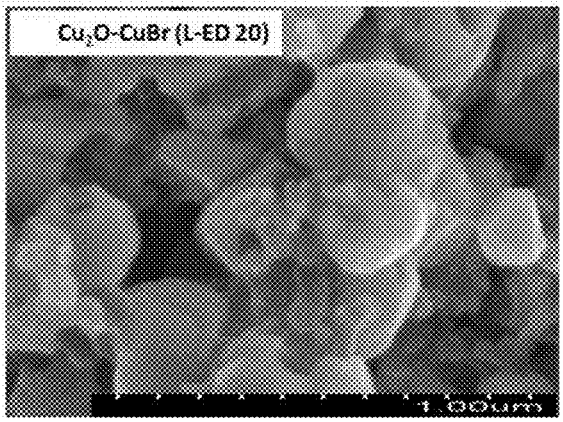
Figure 18A:
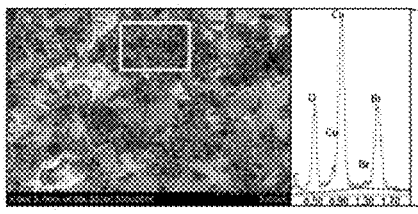
FIG. 18A-18D show SEM images and EDAX analysis of four hybrid films. (18A) prepared in nitrate and bromide in the electrolyte, (18B) prepared in lactic acid electrolyte and with sequential presence of bromide, (18C) prepared with lactic acid and bromide in the electrolyte for 15 min; and (18D) with same conditions as the previous but for 20 min of electrodeposition time.
Figure 18B:
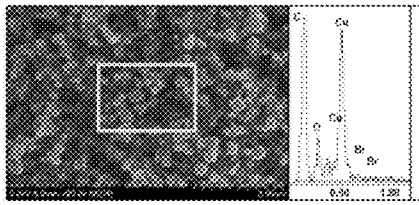
Figure 18C:
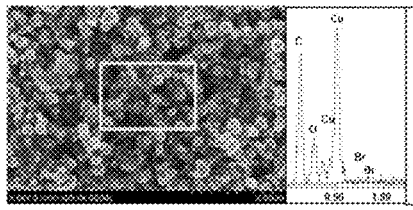
Figure 18D:
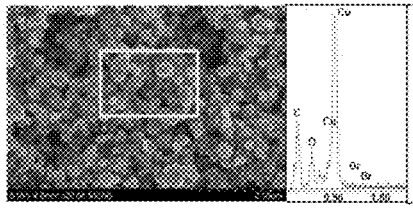

By comparing the SEM images of $Cu_2O$ (FIG. 17A) and hybrid $Cu_2O$/CuBr (FIG. 17B), it is apparent that the neat cubic $Cu_2O$ crystals in the pristine film are eroded in the hybrid film as shown by the uneven corners of the cubic crystals. The simultaneous electrodeposition of $Cu_2O$ and CuBr (films named as $Cu_2O$—CuBr) performed at two electrodeposition times (FIG. 17C for 15 min and FIG. 17D for 20 min) indicates that the resulting films do not contain cubic crystals as was the case for $Cu_2O$/CuBr films obtained by a first step of $Cu_2O$ formation followed by electrodeposition in a solution containing the bromide precursor (FIG. 17B). FIG. 17A-17D compare the 4 types of films and displays that the (100) preferential orientation is only maintained in pristine $Cu_2O$ (FIG. 17A) and in the hybrid $Cu_2O$/CuBr (FIG. 17B). There are no cubic crystals (which are signaling the {100} main orientation) when the bromide precursor is in the electrolyte throughout the electrodeposition time (FIGS. 17C-17D). Therefore, when the growing cubic $Cu_2O$ crystals are exposed during the entire electrodeposition time to the etching effect of bromide in the electrolyte, the resulting films are made of rounded grains which become larger as the electrodepositing time increases (FIGS. 17C-17D).

FIG. 18A-18D compare SEM images and EDX analysis for hybrid films prepared with lactic acid and a film prepared in the absence of lactic acid with the same electrodeposition potential and time. The latter is named as $Cu_2O$—CuBr (N-ED 15) to indicate that both components were electrodeposited simultaneously from a solution containing nitrate ("N") and with an electrodeposition time of 15 minutes. EDX was used to determine chemical film composition in the areas marked with a rectangle.

The more striking observation is that the different surface morphology of the two $Cu_2O$—CuBr films prepared as (N-ED 15) and as (L-ED 15). Both films were grown at −0.4 V for 15 min and the most significant difference is the nitrate (at pH 6) vs. lactate (at pH 9) in the electrolyte. Not only the morphology is significantly different but the uptake of bromide in the film is more than an order higher in the first case. In addition, film porosity is much higher in the L-versus the N-film as indicated by the intensity of the background carbon detection coming from the GDL film support (FIG. 18A-18D).

The EDX senses the oxygen (from air) absorbed at each film surface. Table 4 displays the respective film compositions by leaving aside the oxygen detected and considering only the atom % of Br and Cu. The amount of bromide atomic % (last column in Table 4) should be the same as the amount of CuBr in the film and the remnant copper atomic % should be double than the amount of $Cu_2O$. The two components % total the 100% composition of the film.

TABLE 4

Percent film composition as determined by EADX analysis

| Film | EDAX - chemical composition |
|---|---|
| $Cu_2O$—CuBr (N-ED 15) | 32% $Cu_2O$—68% CuBr |
| $Cu_2O$/CuBr (L-ED 15/5) | 93% $Cu_2O$—7% CuBr |
| $Cu_2O$—CuBr (L-ED 15) | 95% $Cu_2O$—5% CuBr |
| $Cu_2O$—CuBr (L-ED 20) | 95% $Cu_2O$—5% CuBr |

Figure 19:
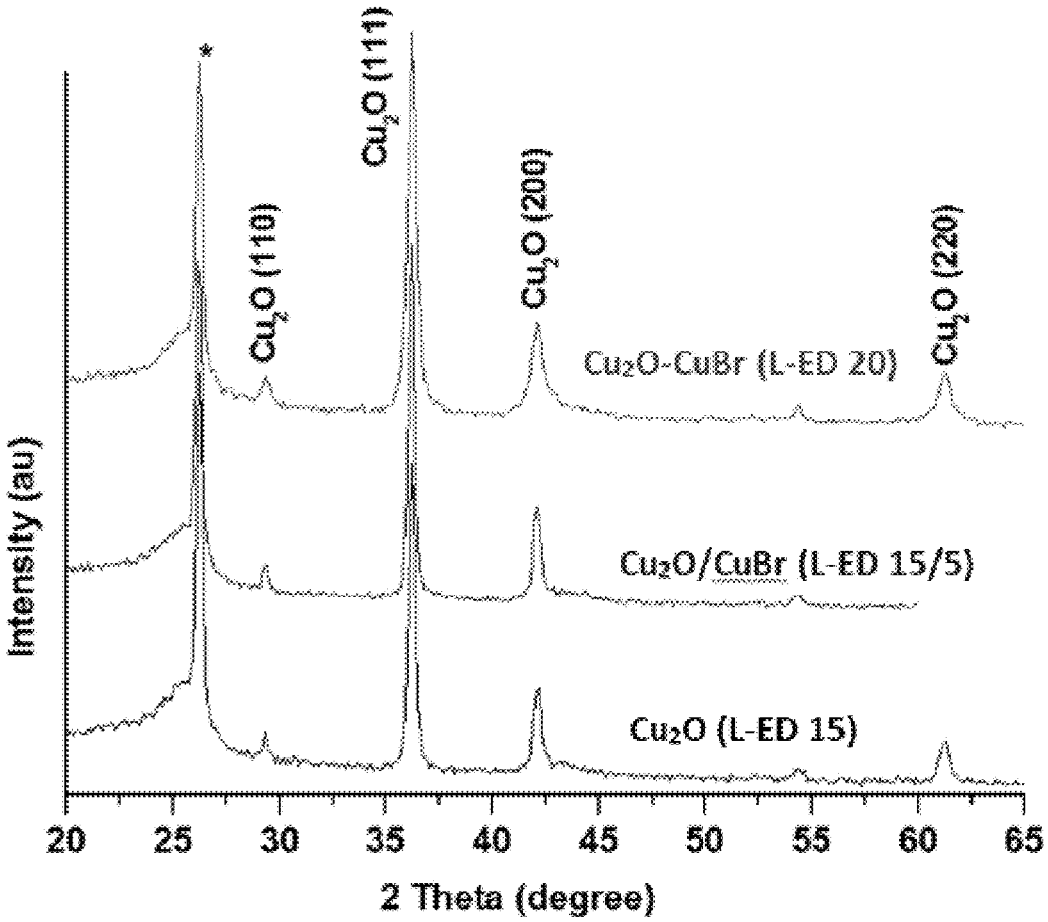
FIG. 19 shows XRD patterns of $Cu_2O$ (L-ED 15), $Cu_2O$/CuBr (L-ED 15/5) and $Cu_2O$—CuBr (L-ED20) films. Films were prepared according to conditions shown in Table 1 (films 1, 2 and 4)
Figures 20A, 20B, 20C, 20D:
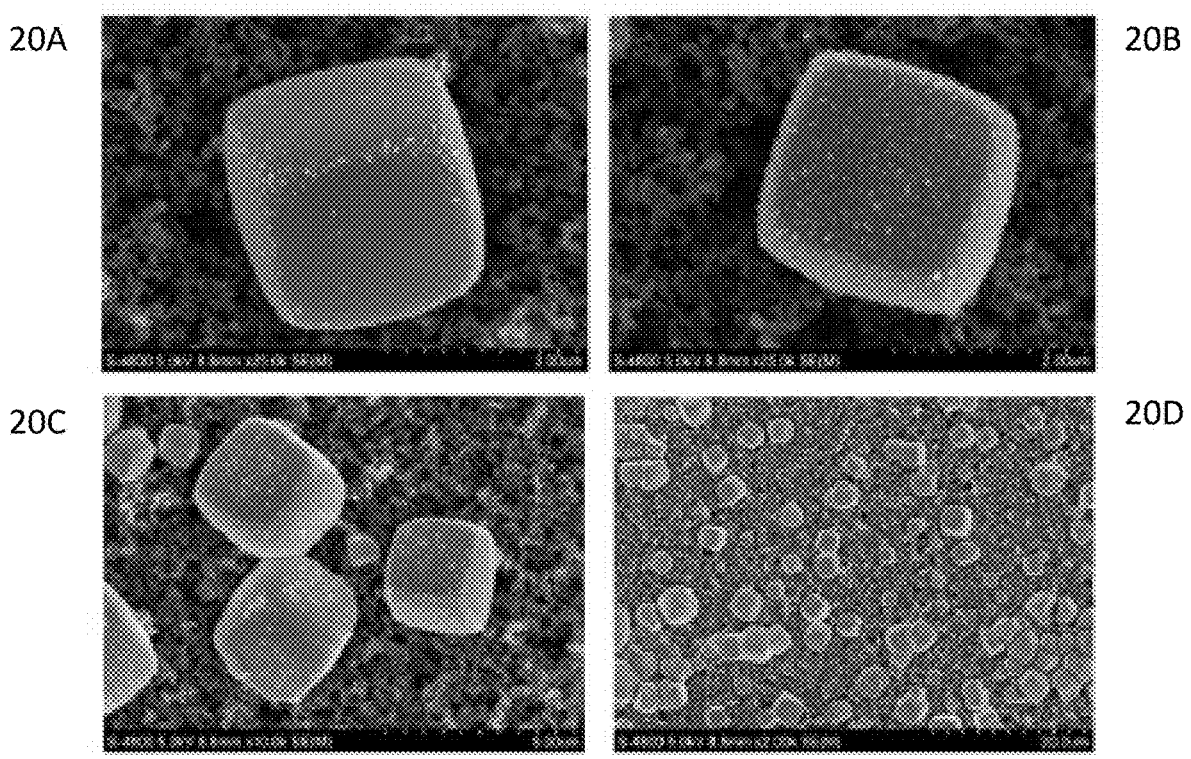
FIG. 20A-20D show representative SEM images of an "as prepared" $Cu_2O$—CuBr (L7-ED35) at open areas of the film.
Figures 21A, 21B, 21C, 21D:
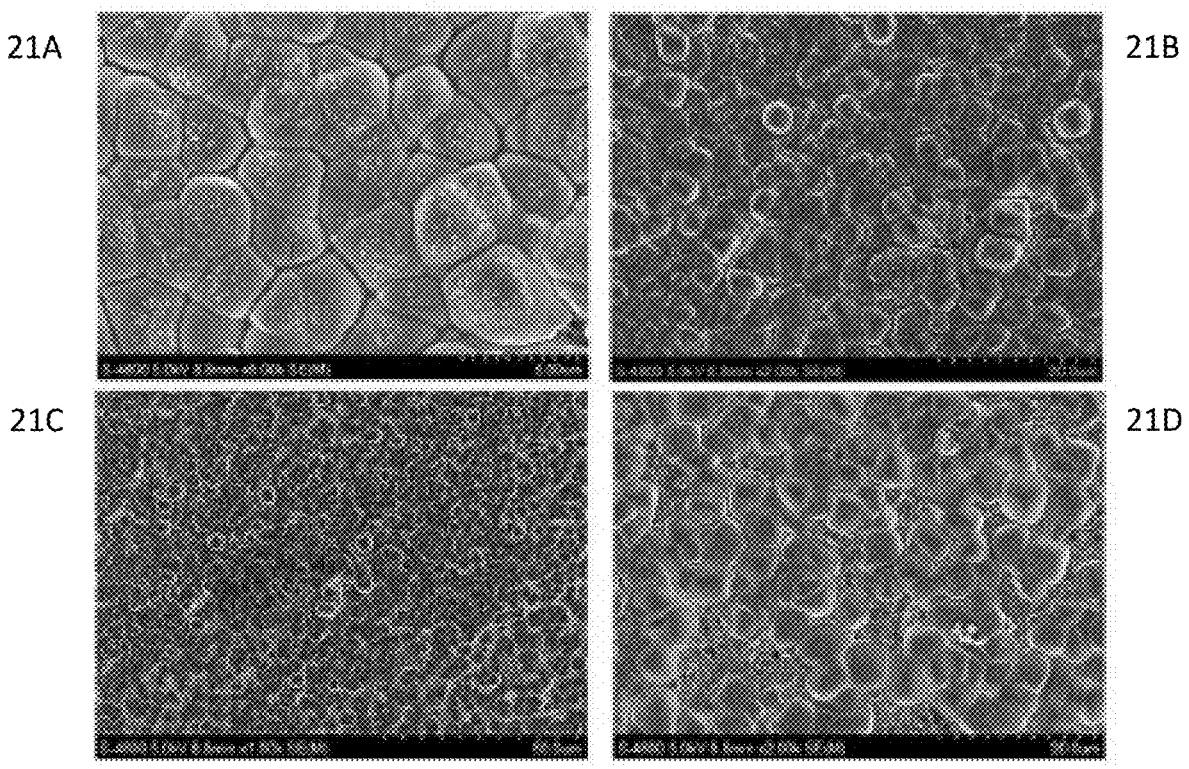
FIG. 21A-21D show representative SEM images of an "as prepared" $Cu_2O$—CuBr (L7-ED35) at densely covered areas of the film.

Table 4 shows the striking difference in film composition for nitrate at pH 6 vs. lactate at pH 9, the latter being mainly $Cu_2O$ with less than 10% of CuBr. XRD data (FIG. 19) corroborates the exclusive high crystalline $Cu_2O$ patterns for films prepared from lactate at pH 9. It is of note that due to the open film morphology made of individual and dispersed cubic crystals, the three dominant (111), (100) and (110) faces of $Cu_2O$ are detected in the XRD patterns instead of a preferential (100) that occurs with a built-up $Cu_2O$ film electrodeposited on a smooth hard surface as substrate. The peak marked with an asterisk is a higher contributor of the XRD patterns because of the high porosity of the electrodeposited film that allows detection of the GDL contribution.

Considering that the L films are rich in $Cu_2O$, a new protocol was used to increase the amount of CuBr by adjusting the electrodeposition bath pH to 7 (films L7) instead of 9 (films L9). Films L7 are also included in Table 2. The SEM characterization of these new L7 films is presented in FIGS. 20A-20D and 21A-21D. The morphology of these new films is interesting because of formation of macro-size perfectly grown cubic structures which contained nanocrystalline planes incrusted in the surface.

Figures 22A, 22B, 22C, 22D:
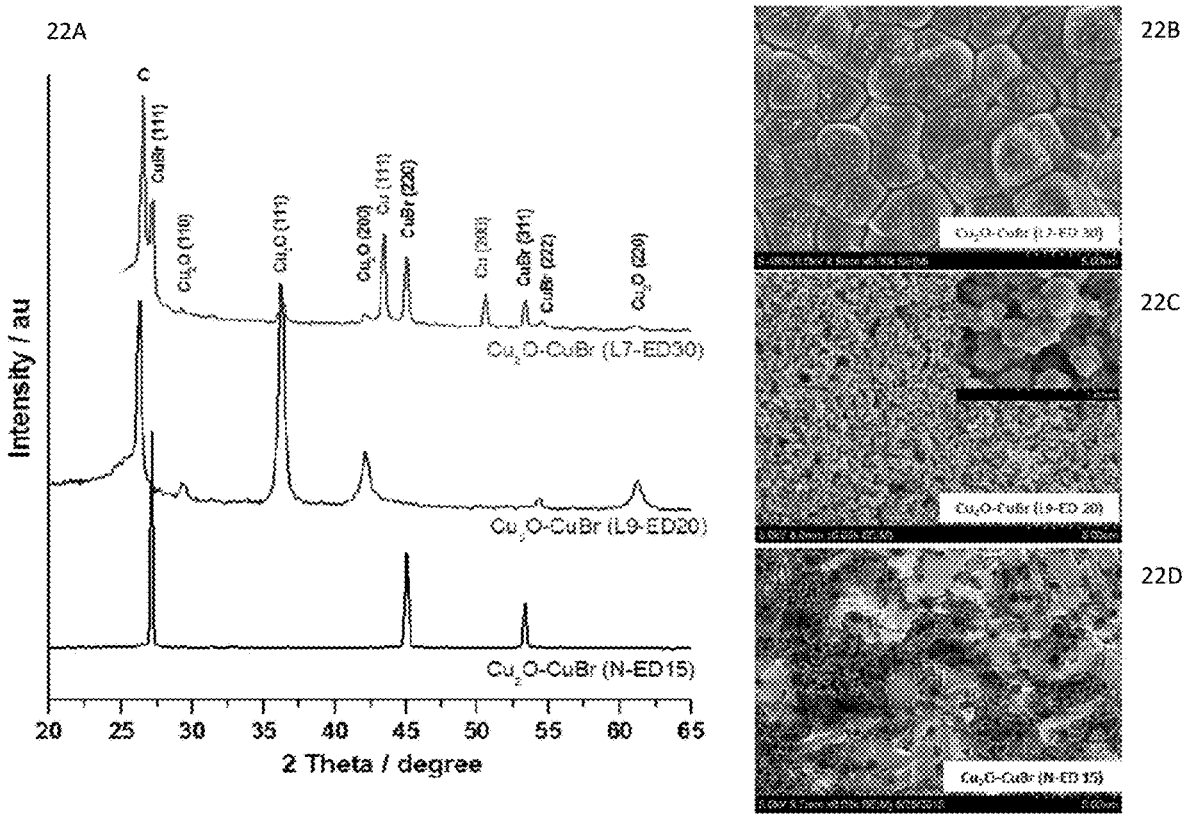
FIG. 22A-22D show XRD patterns (FIG. 22A) and SEM images for $Cu_2O$—CuBr (L7-ED30) (FIG. 22B), $Cu_2O$—CuBr (L9-ED20) (FIG. 22C) and of $Cu_2O$—CuBr (N-ED15) (FIG. 22D) respectively, the respective SEM images of the three types of films are included for the sake of comparison.

In FIG. 22A-22D, the crystalline aspects of these L7 films (FIG. 22A-22B) are compared (through XRD (FIG. 22A) and SEM (FIG. 22B-22D) with those of $Cu_2O$—CuBr (L9-ED20) (FIG. 22C) and of $Cu_2O$—CuBr (N-ED15) (FIG. 22D).

The chemical composition of the hybrid film depends on the pH of the electrodepositing bath. The formation of $Cu_2O$ is enhanced the more alkaline the bath pH is as demonstrated by the EDAX data (compare L9 and L7 films in FIG. 23A-23B). The hybrid film prepared from a nitrate bath (pH 7) as well as SEM images of the three types of films with marked areas where the EDAX analysis are depicted in FIG. 23.

Results

The hybrid films were tested for $CO_2$ electrolysis in a one-compartment electrochemical cell. Film composition and morphology are adjusted by correlating the film surface aspects (chemical and crystalline) with enhanced electrochemical conversion of $CO_2$ to ethylene. The latter is evaluated through product analyses by gas chromatography (GC) together with the current performance during $CO_2$ electrolysis at selected voltages.

GC analyses are used to detect the gaseous products during $CO_2$ electrolysis. Formation of hydrocarbons (ethylene ($C_2H_4$), methane ($CH_4$), ethane ($C_2H_6$), propylene ($C_3H_6$)) is the main outcome of the reaction although spurious hydrogen is frequently found. No CO gas is detected as part of the gaseous products formed during $CO_2$ electrolysis.

Optimized hybrid catalyst films with balanced amounts of the three chemical components provide the high selectivity of ethylene formation during $CO_2$ electrolysis at low temperature (3-5° C.) in alkaline aqueous electrolyte. The low temperatures enhance the conversion of intermediate carbon monoxide (CO) to $C_2H_4$ through a bimolecular electrochemical reaction. Stability and durability of the hybrid films for extended periods of $CO_2$ electrolysis is maintained by in-situ application of few voltage pulses to reactivate surface composition and cleanness.

Table 5 compiles the gaseous products detected by GC and reported as mass % under different applied potentials, electrolyte composition and flow rates, either with $N_2$ or $CO_2$ as carrier gas. All data were obtained with the carrier gas just flowing through the back chamber of the working electrode and thus in contact with the GDL back side which is hydrophobic because it is free of the electrocatalytic deposited $Cu_2O$—CuBr film. The difference in hydrophobicity at the back and hydrophilicity at the top (due to the presence of $Cu_2O$—CuBr film) enhances the transport of hydrocarbon gases to the back of the GDL and thus avoiding accumulation of generated gases at the electrocatalytic top side which otherwise would block surface area and thus decrease the rate of the electrochemical reaction. Moreover, as we are using an aqueous electrolytic media, the hydrophobic/hydrophilic properties of the GDL/$Cu_2O$—CuBr cathode preclude the passage of the electrolyte to the back chamber separated by the back side of the GDL.

TABLE 5

GC product detection obtained during the electrochemical reduction of $CO_2$ on hybrid $CU_2O$—CuBr films

| Film | Electrolyte | Flow Rate m./min | Potential/ V vs. Ag/AgCl | Current Density mA · cm$^{-2}$ | Selectivity (mass %) $CH_4$ | $C_2H_6$ | $C_2H_4$ | $C_3H_6$ | $H_2$ | Abundance (ppmv) |
|---|---|---|---|---|---|---|---|---|---|---|
| $Cu_2O$— | $NaHCO_3$ | $N_2$-10 | −0.4 | 0.13 | | | | | | |
| CuBr | (0.1 M) | | −2.0 | 0.70 | | | | | 100.0 | |
| (N- | | | −2.5 | 0.86 | | | | | 100.0 | |
| ED15) | | | −3.0 | 1.06 | | | | | 100.0 | |

TABLE 5-continued

GC product detection obtained during the electrochemical reduction of $CO_2$ on hybrid $CU_2O$—CuBr films

| Film | Electrolyte | Flow Rate m./min | Potential/ V vs. Ag/AgCl | Current Density mA · cm$^{-2}$ | Selectivity (mass %) $CH_4$ | $C_2H_6$ | $C_2H_4$ | $C_3H_6$ | $H_2$ | Abundance (ppmv) |
|---|---|---|---|---|---|---|---|---|---|---|
| $Cu_2O$—CuBr (N-ED15) | $NaHCO_3$ (0.1 M) | $CO_2$-1 | −0.7 | 0.07 | | | | | | |
| | | | −1.5 | 0.15 | 0.05 | | 0.05 | | 99.90 | |
| | | | −2.0 | 0.20 | 0.01 | | 0.05 | | 99.92 | |
| | | | −3.0 | 0.31 | 0.04 | | | | 99.96 | |
| | | | −4.0 | 0.42 | 0.05 | | | | 99.95 | |
| | | | −5.0 | 0.45 | 0.02 | | | | 99.98 | |
| $Cu_2O$—CuBr (N-ED15) | $Na_2SO_4$ (0.1 M) | $CO_2$-4 | −2.0 | 4.87 | | 0.03 | 0.10 | | 99.87 | $H_2$ 20,000 |
| | | $CO_2$-2.5 | −2.0 | 4.87 | 0.01 | 0.02 | 0.07 | | 99.90 | $C_2H_4$ 1.5 |
| | | $CO_2$-1 | −2.0 | 4.87 | 0.01 | 0.02 | 0.04 | | 99.93 | |
| | | $CO_2$-0.5 | −2.0 | 4.87 | 0.02 | 0.01 | 0.02 | | 99.95 | |
| $Cu_2O$—CuBr (N-ED15) (Charge 70 C.) | KOH (1 M) ph11 | $CO_2$-1 | −0.7 | 1.11 | 1.05 | | 2.93 | | 95.52 | $H_2$ 20,000 |
| | | $CO_2$-1 | −1.0 | 13.94 | 0.02 | 0.11 | 0.87 | | 99.01 | $C_2H_4$ 1,900 |
| | | $CO_2$-1 | −2.5 | 18.80 | 0.02 | 0.45 | 4.18 | 0.01 | 95.34 | |
| | | $CO_2$-1 | −3.0 | 28.76 | 0.01 | 1.25 | 14.4 | 0.06 | 84.27 | |
| $Cu_2O$—CuBr (N-ED15) (Charge 70 C.) | KOH (1 M) ph11 | $N_2$-1 | −0.7 | 2.82 | | | | | 100.0 | |
| | | $N_2$-1 | −1.5 | 7.19 | | | | | 100.0 | |
| | | $N_2$-1 | −2.0 | 21.68 | | | | | 100.0 | |
| | | $N_2$-1 | −2.5 | 37.17 | | | | | 100.0 | |
| | | $N_2$-1 | −3.0 | 53.10 | | | | | 100.0 | |
| $Cu_2O$—CuBr (L-ED35) (Charge 70 C.) | | $CO_2$-1 | −0.7 | 0.34 | | | | | 100.0 | $H_2$ 230,000 |
| | | $CO_2$-1 | −1.5 | 6.57 | 0.01 | 0.02 | 0.09 | 0.06 | 99.81 | $C_2H_4$ 60 |
| | | $CO_2$-1 | −2.0 | 14.82 | | 0.03 | 0.55 | 0.03 | 99.40 | |
| | | $CO_2$-1 | −2.5 | 25.44 | | 0.01 | 0.05 | | 99.94 | |
| | | $CO_2$-1 | −3.0 | 36.06 | | | 0.06 | 0.02 | 99.91 | |
| $Cu_2O$—CuBr (L-ED35) (Charge 70 C.) | KOH (1 M) ph11 | $CO_2$-2.5 | −1.5 | 7.19 | 0.02 | 0.01 | 0.04 | 0.01 | 99.92 | |
| | | $CO_2$-2.5 | −2.0 | 15.26 | 0.01 | 0.01 | 0.03 | 0.02 | 99.95 | |
| $Cu_2O$—CuBr (L-ED35) (Charge 70 C.) | KOH (1 M) ph8 | $CO_2$-2.5 | −3.0 | 59.73 | 0.20 | 0.10 | 27.3 | 0.21 | 72.30 | |

In situ GC detection during $CO_2$ electrolysis was performed. The performances of different $Cu_2O$—CuBr hybrid films were analyzed. For a nitrate-prepared hybrid film on GDL (i.e., N-ED15), product formation as a function of potentials in the potential range between −0.5 V to −5 V indicated that the best performance occurs at −3 V, although significant ethylene formation was seen at ca. −0.7 V and pointing out to CO conversion into $C_2H_4$. In general, the N-ED15 films were found to generate a maximum of 19% mass efficiency of ethylene and 81% mass of $H_2$ and showed better performance than films prepared from lactic acid (i.e. L-ED35).

Figure 24:
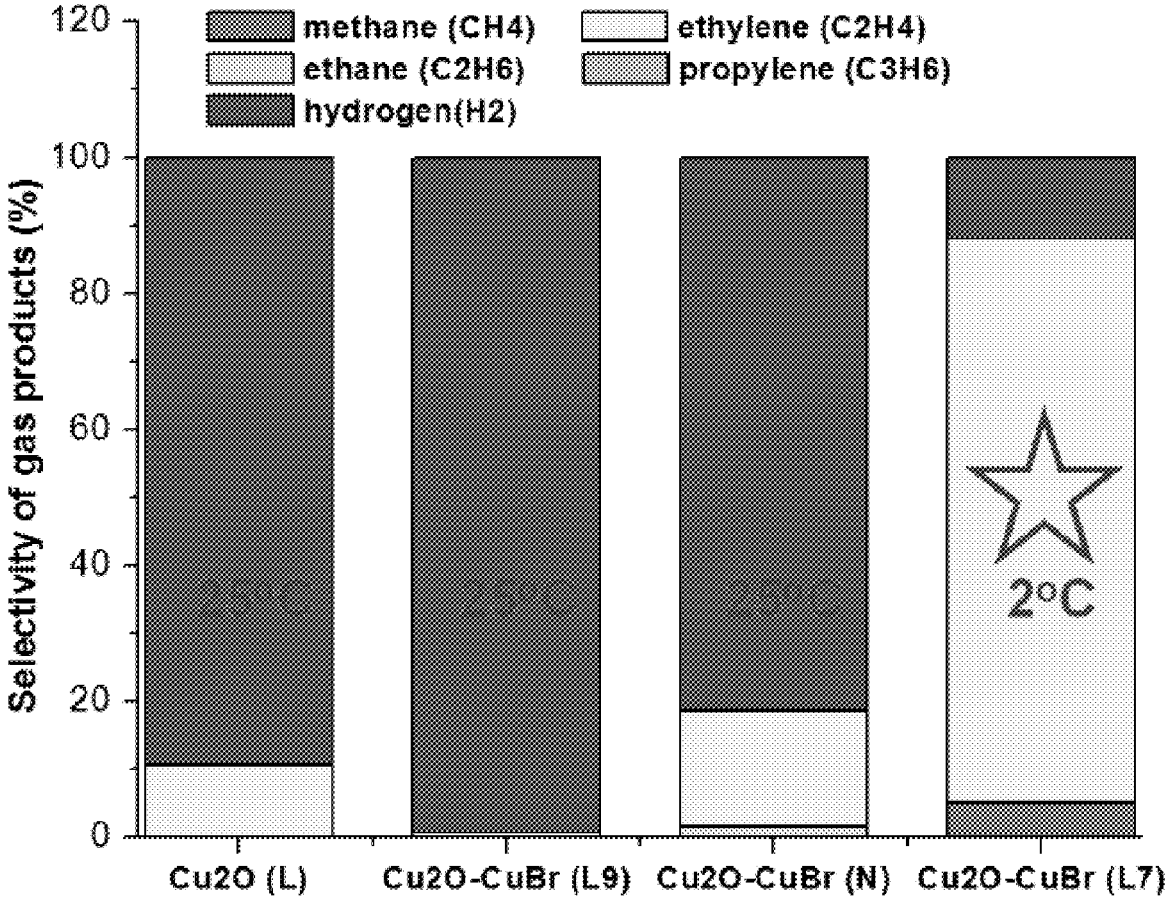
FIG. 24 shows comparison of product selectivity on three hybrid $Cu_2O$—CuBr films recorded at −3V in 1M KOH electrolyte. Products formed in a pristine $Cu_2O$ film are also presented as a comparison. All films were electrodeposited on GDL substrate. The counter-electrode was electrodeposited Pt film (4.5 C/cm$^2$) on GDL.

A comparison of four electrode compositions for selective ethylene formation during the $CO_2$ electroreduction is shown in FIG. 24. The comparison includes three hybrid $Cu_2O$—CuBr films of different composition and a pristine $Cu_2O$ film. Thus, on $Cu_2O$ (L9), $Cu_2O$—CuBr (L9) and $Cu_2O$—CuBr (N) cathode films, the major gaseous product was hydrogen. However, for the new hybrid $Cu_2O$—CuBr (L7) film, the main product was ethylene and its amount was enhanced at low temperature and with stirring of the 1M KOH electrolyte solution (FIG. 24). The $Cu_2O$—CuBr (L7) film is able to form 83% $C_2H_4$, 5% $CH_4$ and 12% $H_2$ with all percentage of gases reported in mass %. Importantly, the electrolyte low temperature and constant stirring cause an increase in the $C_2H_4$ production on L7 films from ~51% to 83% (data not shown). In fact, FIG. 24 summarizes an important milestone for the cathode formulation and the twining of electrolyte conditions for high electrocatalytic $C_2H_4$ generation.

In order that the cathode performance and durability can be maintained for extended periods of time (months), a pulsed voltage protocol is designed to reactivate the surface of the cathode film in contact with the electrolyte (1M NaOH). This pulsed electrochemical activation (PECA) is tailored to sustain high cathode currents during $CO_2$ electrolysis. The PECA will recover the surface film composition and also remove residual adsorbed reaction intermediates blocking the catalyst surface.

The high electrocatalytic performance of the cathode for the $CO_2$ electroreduction to ethylene is supported by the presence of $Cu_2O$—CuBr entities in near proximity with metallic copper (Cu) sites at the electrode surface. However, the cathodic current during $CO_2$ electrolysis decreases by ca. 18% in the first hour and then more slowly, at ca. 2.7% per hour, as the time progresses. The decrease is mainly attributed to changes at the cathode surface where $Cu_2O$ and CuBr become less accessible for $CO_2$ entities because long term application of negative voltages brings about a progressive transformation of the catalytic $Cu_2O$ component (but not of CuBr) to metallic Cu, thus making the film surface mainly dominated by metallic copper as shown in equation 1:

$$Cu_2O+2e^-+2H^+ \rightarrow 2Cu+H_2O \quad (1)$$

Figure 25:
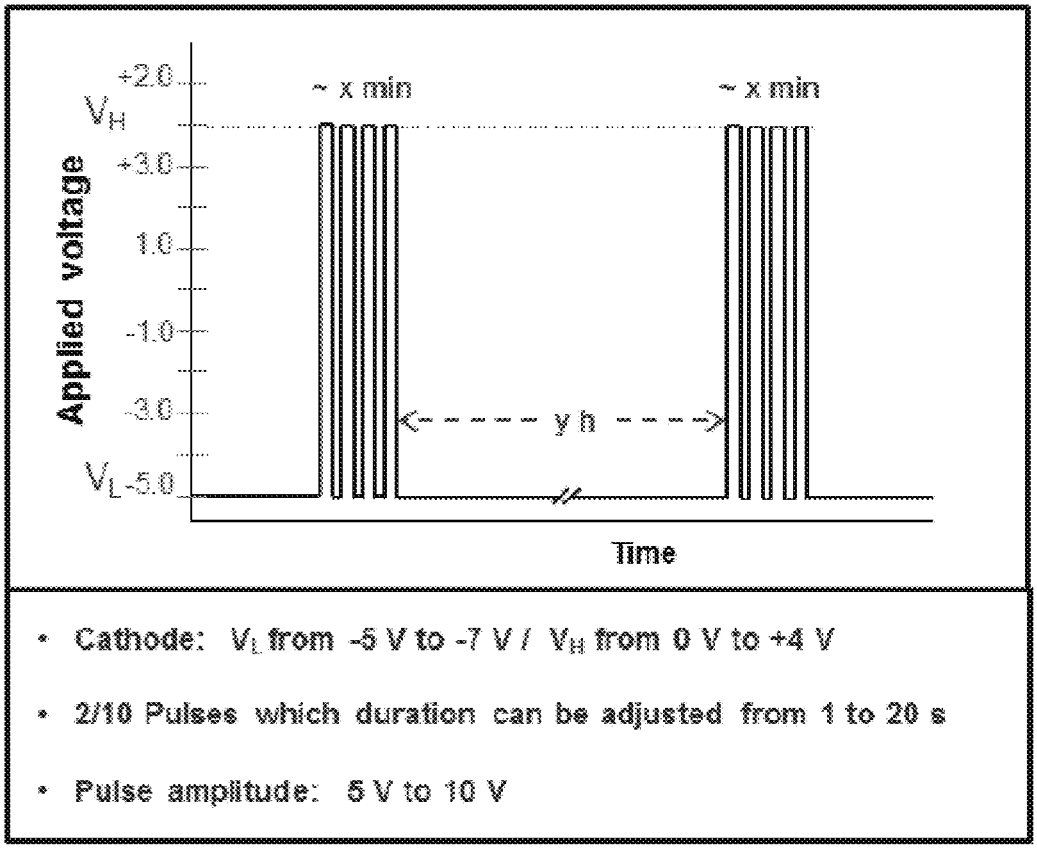
FIG. 25 shows a scheme of the square pulses to be applied periodically to the cathode for activation of the electrocatalytic performance during the $CO_2$ electrolysis. Low and high voltage limits for the cathode are defined as $V_L$ hand $V_H$ respectively. Other conditions are described at the bottom of the figure.

Therefore, square voltage pulses (from $V_L$ (low voltage) to $V_H$ (high voltage) are applied to recover the catalytic cathode surface. The PECA procedure consists of square pulses applied periodically (every y hours, with y=1 to 24) to recover the current performance of the electrode during the $CO_2$ electrolysis and to therefore maintain and/or reactivate the high electrocatalytic conversion of $CO_2$ to ethylene on the electrode surface. FIG. 25 shows a representative scheme of the voltage/time to be applied to re-activate the hybrid catalytic film. The time period (y) in between application of few pulses can be determined, in order to evaluate long wait times (i.e.; 24 h) are ideal and followed many pulses or to otherwise decrease the number of pulses (applied for x min) and increase how frequently (every hour for instance). The pulse duration and symmetry can be adjusted also (from 0.3 s to 20 s range).

During the periods at $V_H$, the metal Cu regions of the cathode surface would be partially converted (at short pulse duration) to soluble $Cu^+$ cations which would react with the OH— electrolyte to regenerate $Cu_2O$ entities, as shown in reactions (2a) and (2b):

$$2Cu \rightarrow Cu^+ + e^- \quad (2a)$$

$$2Cu+2OH_- \rightarrow Cu_2O+H_2O+2e_- \quad (2b)$$

leading to the following stoichiometric reaction:

$$2Cu+2OH_- \rightarrow Cu_2O+H_2O+2e_- \quad (2)$$

In fact, equation (2) is expected to occur after Cu sites located at the cathode surface are oxidized at the positive voltages reached by the pulses. The voltage limits (positive and negative) can to be adjusted to recover the electrocatalytic film, meaning that the soluble $Cu^+$ species is brought back to the cathode as $Cu_2O$ during the negative voltage period of the pulses. It is important to avoid that some of the $Cu^+$ cations could be taken away by the electrolyte flow because this occurrence would be detrimental to the overall film recovery according to reaction (2).

Figure 26:
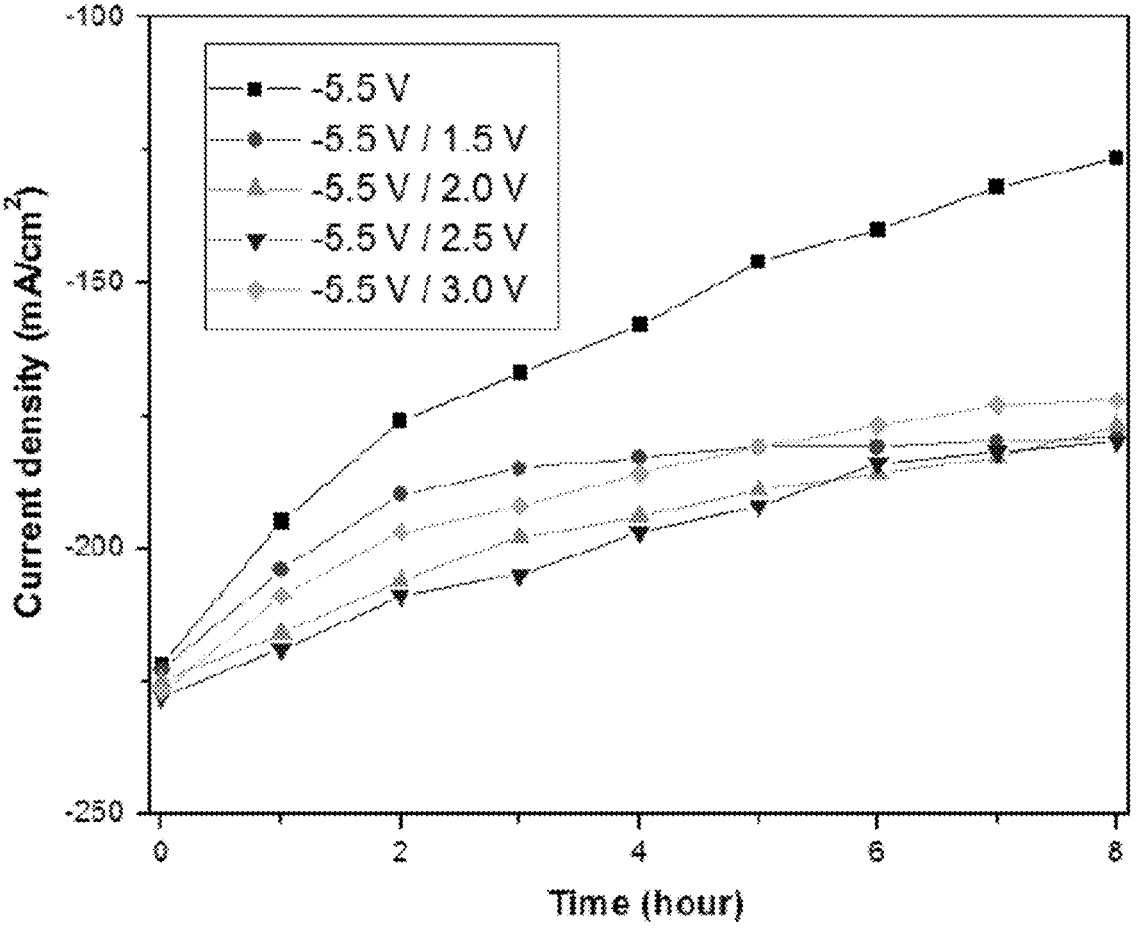
FIG. 26 shows current/time performance during $CO_2$ electrolysis at −5.5 V without PECA (squares) and with PECA (circles, upward triangle, downward triangle, and diamond) and with four pulses, 10 s/10 s) performed every hour. In all cases, the cathode consisted of $Cu_2O$—CuBr (L-pH7) while the anode was a Pt foil. Both electrodes were located in a batch cell containing 1M KOH at 25° C. The PECA traces (circles, upward triangle, downward triangle, and diamond) were performed with a PECA protocol involving four symmetric pulses ($V_L$ (10 s)/$V_H$ (10 S) where $V_L$=−5.5. V and $V_H$=1.5, 2.0, 2.5 and 3.0 V respectively (as indicated in the caption inside the plot).

A representative comparison of the current performance during $CO_2$ electrolysis for an extended time of 8 hours without (squares) and with PECA (circles, upward triangle, downward triangle, and diamond) protocol performed every hour is shown in FIG. 26. The $V_L$ in the PECA was kept at −5.5 V because it was a preferred value for continuous conversion of $CO_2$ to ethylene. Currents are displayed as negative to agree with the sign of the respective voltage $V_L$.

In the absence of PECA (FIG. 26 squares), the $CO_2$ electrolysis current continuously decreases, although the rate of decrease becomes lower as the time increases. The current decrease was found to be associated with lower ethylene formation. Based on the fact that the highest decrease in current is occurring during the first 1-2 hours of the process, the PECA procedure is applied every hour (instead of after several hours as schematized in FIG. 25) and using 4 pulses with same negative voltage (VL=−5.5 V) and different positive VH (=1.5, 2.0, 2.5 and 3.0 V) respectively. The resulting current/time profiles with the PECA protocol are included in FIG. 26 (circles, upward triangle, downward triangle, and diamond). For all these profiles, 4 identical pulses are applied with symmetrical waveform (10 seconds at VH and other 10 seconds at VL).

Figure 27A:
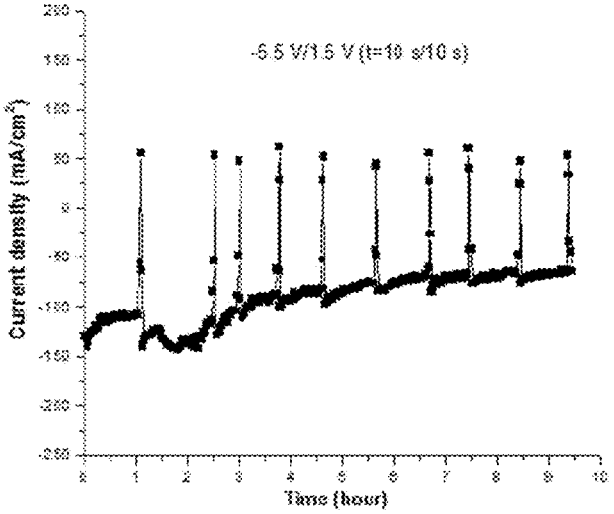
FIG. 27A-27B shows (a) current/time and (b) gas product formed during $CO_2$ electrolysis at 5 C with a $Cu_2O$—CuBr (L-pH7) as cathode, the stationary cathodic current is quite stable because of the pulsed activation (10 s/10 s every hour) and the amount of ethylene is kept at ~80% of the total amount of gas formed, with hydrogen being the second predominant product (in the range 15-18%).
Figure 27B:
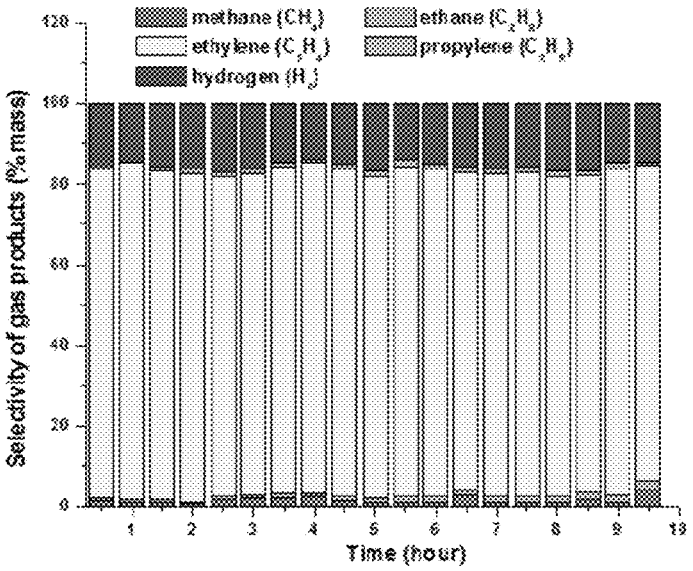

Finally, the current density performance of the L7 hybrid film subjected to PECA protocol as well as the GC analysis of gases at the back of the cathode electrode is shown in FIG. 27A-27B. The applied PECA was four 10 s/10 s pulses every hour. FIG. 27A shows the recorded current/time profile which includes the current transients due to PECA protocol performed every hour. Importantly, the stationary current is quite constant because of the PECA protocol.

Table 6 shows the relevant prior works for production of $C_2H_4$ from $CO_2$. Table 6 indicates that reference has developed such high catalytic films and electrodeposited these types of catalytic films on GDL substrates for selective formation of $C_2H_4$ during electrolysis of $CO_2$. The key performance is due to the ternary composition of the hybrid films. Very highly porous and highly electrically conductive GDL was selected to assure the $CO_2$ gas passage from the back of the layer (gas permeability=1.5 s) to the front where the catalytic hybrid film produces the enhanced electroreduction of $CO_2$.

TABLE 6

| Catalyst | Electroreduction Condition | Faradaic Efficiency (%) | Publication |
|---|---|---|---|
| Cu/Teflon/Carbon black on GDL | 1M KOH, −3.0 V Ag/AgCl | 69% $C_2H_4$<br>9.1% $CH_4$ | J. ECS (1990) |
| CuBr on Cu mesh | 3M KBr, −2.4 V Ag/AgCl | 79.5% $C_2H_4$<br>5.8% $CH_4$<br>2.4% CO<br>9.3% $H_2$ | J. $CO_2$ utilization (2013 |
| Electrodeposited $Cu_2O$/Cu on GDL | 0.5M $KHCO_3$, −2.1 V Ag/AgCl | 55% $C_2H_4$<br>10% $CH_4$ | Phys. Chem. Chem. Phys (2015) |
| Thermal oxidation CuO/Cu | 1M $KHCO_3$, pulse polarization between −2.1 and 0.5 V | 55% $C_2H_4$<br>20% $CH_4$ | J. Solid State Electrochem (2007) |
| Cu nanoparticle/Carbon black | 0.1M $KHCO_3$, −2.0 V Ag/AgCl | 42% $C_2H_4$<br>9.1% $CH_4$<br>4% CO<br>18% $H_2$ | ACS. Catal (2014) |
| Electroreduced CuCl film to Cu mesocrystals | 0.1M KHCO3, −1.0 V RHE | 30% $C_2H_4$<br>5% $CH_4$<br>4% CO<br>45% $H_2$ | Catal. Sci. Technol (2015) |
| Pt-Thin Cu metal | 0.1M KHCO3, −1.1 V RHE | 18% $C_2H_4$<br>35% $CH_4$ | J. Phys. Chem. Lett (2013) |

No reference has prepared a GDL supported hybrid catalyst with hydrophilic top performance in order to enhance the reaction at the film surface level of $CO_2$ with electron and water to generate ethylene (C2H4) as indicated in the following equation:

$$CO_2+H_2O \rightarrow 0.5C_2H_4+1.5O_2$$

An in-situ reactivation of the catalyst film has been developed. No reference has reported the formation of ethylene at electrolysis times longer than 6 hours. The film shows the higher selectivity for ethylene formation which can reach up to 88 mass %.

FIG. 28 shows a reactor using a solid electrolyte. The liquid electrolyte of FIG. 14 is replaced with a solid electrolyte.

Figure 29:
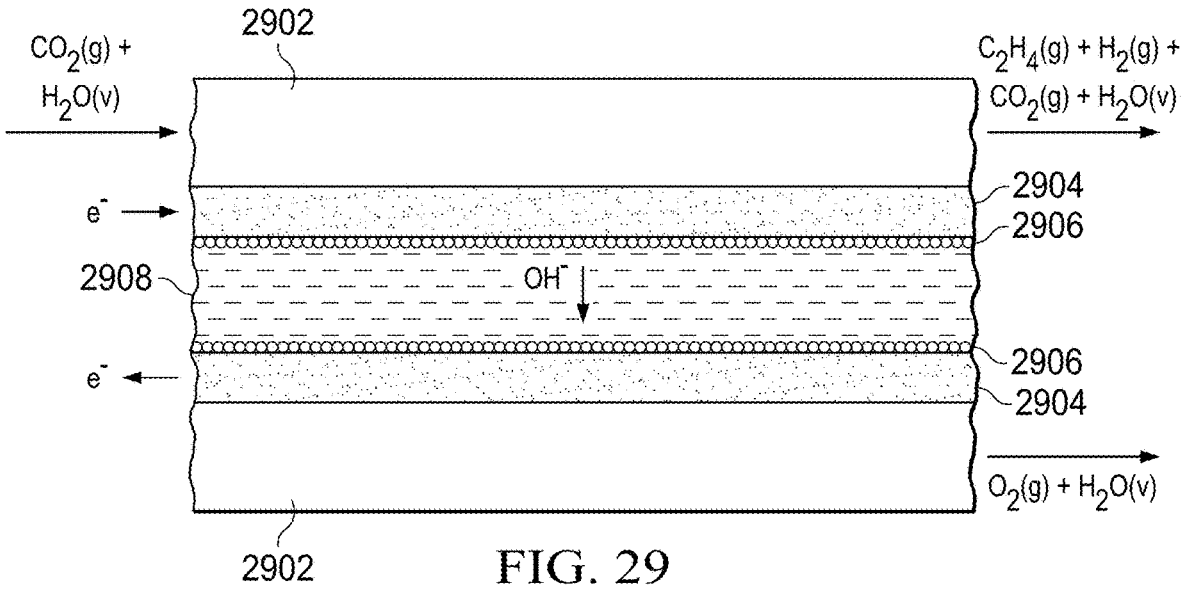
FIG. 29 shows a reactor for ethylene production using an anion conducting solid electrolyte.

FIG. 29 shows a reactor for ethylene production using an anion conducting solid electrolyte 2908. $CO_2$ humidified with water enters the channel 2902, diffuses through the GDL 2904 and contacts with the catalyst 2906 where the $CO_2$ and water are reduced to form gaseous hydrocarbons and hydroxide ions. The hydroxide ions diffuse through the membrane and are oxidized on the anode to form oxygen and water. The humidity of the $CO_2$ should be adjusted such that molar ratio of $CO_2$ to $H_2O$ is greater than or equal to 1.

Figure 30:
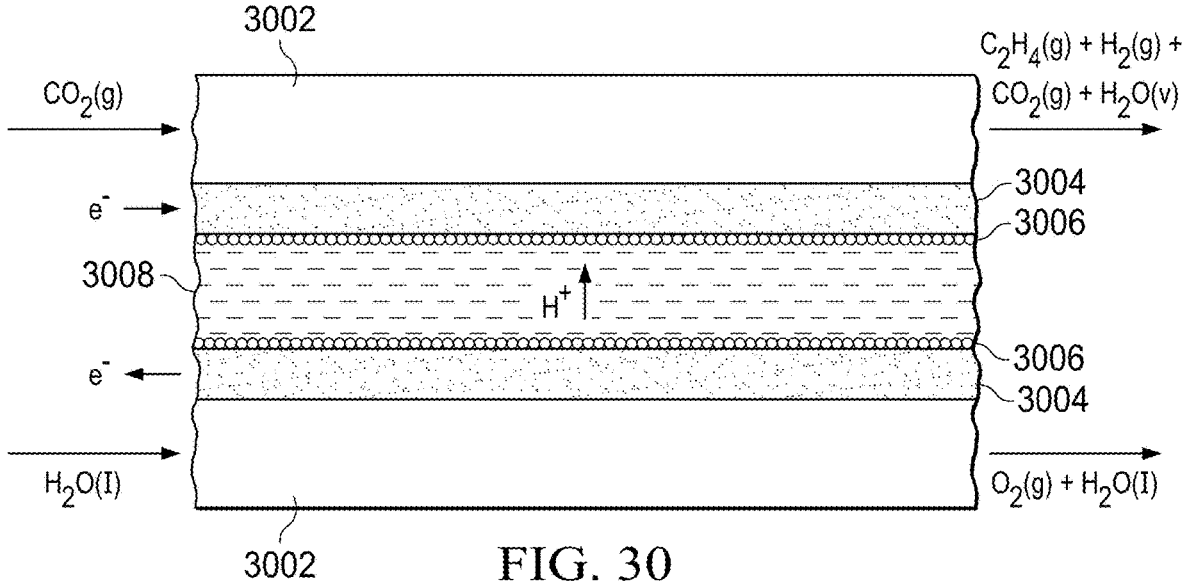
FIG. 30 shows a reactor for ethylene production using a cation conducting solid electrolyte.

FIG. 30 shows a reactor for ethylene production using a cation conducting solid electrolyte 3008. $CO_2$ enters the channel 3002, diffuses through the GDL 3004 and contacts with the catalyst 3006 where the $CO_2$ and protons are reduced to form gaseous hydrocarbons and water. Water is oxidized on the anode side to produce oxygen and protons that diffuse across the electrolyte membrane. The oxygen is in the form of gas bubbles is carried out of the reactor by the flowing water.

All of the compositions and methods disclosed and claimed herein can be made and executed without undue experimentation in light of the present disclosure. While the compositions and methods of this disclosure have been described in terms of preferred embodiments, it will be apparent to those of skill in the art that variations may be applied to the compositions and methods and in the steps or in the sequence of steps of the methods described herein without departing from the concept, spirit and scope of the disclosure. More specifically, it will be apparent that certain agents which are both chemically related may be substituted for the agents described herein while the same or similar results would be achieved. All such similar substitutes and modifications apparent to those skilled in the art are deemed to be within the spirit, scope and concept of the disclosure as defined by the appended claims.

The invention claimed is:

1. An electrochemical reactor for use with an electrolyte that generates gaseous products, comprising:

an electrolyte channel, wherein the electrolyte channel does not comprise a solid, a first and a second electrode layer and a first and a second gas channel;

wherein:

(a) the first electrode layer is directly adjacent the electrolyte channel, (b) the second electrode layer is directly adjacent the electrolyte channel, (c) the first electrode layer separates the electrolyte channel and the first gas channel, (d) the second electrode layer separates the electrolyte channel and the second gas channel, (e) each electrode layer comprises a gas side and a catalyst side, wherein the catalyst side comprises a catalyst layer comprising a catalyst, wherein the catalyst layer is directly adjacent to the electrolyte channel; and (f) each electrode layer is hydrophilic on the catalyst side and hydrophobic on the gas side.

2. The electrochemical reactor of claim 1, wherein each electrode layer comprises an electrically conducting porous layer on the gas side of the electrode layer.

3. The electrochemical reactor of claim 2, wherein the electrically conducting porous layer is made from a hydrophobic material.

4. The electrochemical reactor of claim 3, wherein the hydrophobic material is polytetrafluoroethylene.

5. The electrochemical reactor of claim 2, wherein the catalyst is electrodeposited on the catalyst side of the electrode layer.

6. The electrochemical reactor of claim 2, wherein the catalyst is Pt, Ru, Cu, Ti, Ni, or Cu—Br.

7. The electrochemical reactor of claim 2, wherein the catalyst is formed from a hybrid $Cu_2O$—CuBr film.

8. The electrochemical reactor of claim 1, wherein the electrolyte is an anion conducting electrolyte.

9. The electrochemical reactor of claim 1, wherein the electrolyte is a cation conducting electrolyte.

10. The electrochemical reactor of claim 1, wherein the electrolyte is NaOH, $NaHCO_3$, KOH, or $Na_2SO_4$.

11. A system for producing $C_2H_4$ from $CO_2$, comprising an electrochemical reactor of claim 7, and a liquid electrolyte, wherein the liquid electrolyte is an anion conducting electrolyte, a cation conducting electrolyte, or an electrolyte selected from the group consisting of NaOH, $NaHCO_3$, KOH, or $Na_2SO_4$.

12. The system of claim 11, wherein the liquid electrolyte is pumped continuously into the electrolyte channel of the electrochemical reactor.

* * * * *